US007944331B2

(12) United States Patent
Porter et al.

(10) Patent No.: US 7,944,331 B2
(45) Date of Patent: May 17, 2011

(54) CIRCUIT INTERRUPTING DEVICE WITH REVERSE WIRING PROTECTION

(75) Inventors: James A. Porter, Farmingdale, NY (US); James Richter, Bethpage, NY (US); Frantz Germain, Rosedale, NY (US); Armando Calixto, Floral Park, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 613 days.

(21) Appl. No.: 11/265,803

(22) Filed: Nov. 2, 2005

(65) Prior Publication Data

US 2006/0139132 A1 Jun. 29, 2006
US 2010/0001819 A9 Jan. 7, 2010

Related U.S. Application Data

(63) Continuation-in-part of application No. 10/692,056, filed on Oct. 22, 2003, now Pat. No. 7,049,911, which is a continuation of application No. 10/690,776, filed on Oct. 22, 2003, now Pat. No. 7,737,809.

(60) Provisional application No. 60/444,469, filed on Feb. 3, 2003.

(51) Int. Cl.
*H01H 73/00* (2006.01)

(52) U.S. Cl. ..... 335/18; 361/40

(58) Field of Classification Search ..... 335/18; 361/42–51

See application file for complete search history.

(56) References Cited

U.S. PATENT DOCUMENTS 3,309,571 A 3/1967 Gilker
3,538,477 A 11/1970 Walters et al.
3,702,418 A 11/1972 Obenhaus
3,766,434 A 10/1973 Sherman
3,813,579 A 5/1974 Doyle
3,864,649 A 2/1975 Doyle
3,872,354 A 3/1975 Nestor et al.
3,949,336 A 4/1976 Dietz
4,002,951 A 1/1977 Halbeck
4,010,431 A 3/1977 Virani
4,010,432 A 3/1977 Klein
4,034,266 A 7/1977 Virani et al.
4,034,360 A 7/1977 Schweitzer, Jr.
4,051,544 A 9/1977 Vibert (Continued)

FOREIGN PATENT DOCUMENTS

DE 2281138 11/1978

(Continued)

OTHER PUBLICATIONS

PCT International Search Report and Written Opinion, PCT/US06/60489, dated Jul. 17, 2008.

(Continued)

*Primary Examiner* — Anh T Mai
*Assistant Examiner* — Bernard Rojas
(74) *Attorney, Agent, or Firm* — Carter, DeLuca, Farrell & Schmidt, LLP

(57) ABSTRACT

Resettable circuit interrupting devices, such as GFCI devices, that include reverse wiring protection, and optionally an independent trip portions and/or a reset lockout portion are provided. The reverse wiring protection operates at both the line and load sides of the device so that in the event line side wiring to the device is improperly connected to the load side, fault protection for the device remains. The trip portion operates independently of a circuit interrupting portion used to break the electrical continuity in one or more conductive paths in the device. The reset lockout portion prevents the reestablishing of electrical continuity in open conductive paths if the circuit interrupting portion is non-operational or if an open neutral condition exists.

37 Claims, 25 Drawing Sheets

U.S. PATENT DOCUMENTS

| | | | |
|---|---|---|---|
| 4,063,299 | A | 12/1977 | Munroe |
| 4,109,226 | A | 8/1978 | Bowling |
| 4,114,123 | A | 9/1978 | Grenier |
| 4,159,499 | A | 6/1979 | Bereskin |
| 4,163,882 | A | 8/1979 | Baslow |
| 4,194,231 | A | 3/1980 | Klein |
| 4,223,365 | A | 9/1980 | Moran |
| 4,288,768 | A | 9/1981 | Arnold et al. |
| 4,316,230 | A | 2/1982 | Hansen et al. |
| 4,377,837 | A | 3/1983 | Matsko |
| 4,386,338 | A | 5/1983 | Doyle |
| 4,409,574 | A | 10/1983 | Misencik |
| 4,412,193 | A | 10/1983 | Bienwald |
| 4,442,470 | A | 4/1984 | Misencik |
| 4,515,945 | A | 5/1985 | Ranken et al. |
| 4,521,824 | A | 6/1985 | Morris et al. |
| 4,538,040 | A | 8/1985 | Ronemus |
| 4,567,456 | A | 1/1986 | Legatti |
| 4,568,899 | A | 2/1986 | May |
| 4,574,260 | A | 3/1986 | Franks |
| 4,578,732 | A | 3/1986 | Draper et al. |
| 4,587,588 | A | 5/1986 | Goldstein |
| 4,595,894 | A | 6/1986 | Doyle et al. |
| 4,630,015 | A | 12/1986 | Gernhardt et al. |
| 4,631,624 | A | 12/1986 | Dvorak et al. |
| 4,641,216 | A | 2/1987 | Morris et al. |
| 4,641,217 | A | 2/1987 | Morris et al. |
| 4,686,600 | A | 8/1987 | Morris et al. |
| 4,719,437 | A | 1/1988 | Yun |
| 4,802,052 | A | 1/1989 | Brant et al. |
| 4,814,641 | A | 3/1989 | Dufresne |
| 4,816,957 | A | 3/1989 | Irwin |
| 4,851,951 | A | 7/1989 | Foster, Jr. |
| 4,901,183 | A | 2/1990 | Lee |
| 4,949,070 | A | 8/1990 | Wetzel |
| 4,967,308 | A | 10/1990 | Morse |
| 4,979,070 | A | 12/1990 | Bodkin |
| 5,144,516 | A | 9/1992 | Sham |
| 5,148,344 | A | 9/1992 | Rao et al. |
| 5,161,240 | A | 11/1992 | Johnson |
| 5,179,491 | A | 1/1993 | Runyan |
| 5,185,687 | A | 2/1993 | Beihoff |
| 5,202,662 | A | 4/1993 | Bienwald et al. |
| 5,218,331 | A | 6/1993 | Morris |
| 5,223,810 | A | 6/1993 | Van Haaren |
| 5,224,006 | A | 6/1993 | MacKenzie et al. |
| 5,229,730 | A | 7/1993 | Legatti |
| 5,239,438 | A | 8/1993 | Echtler |
| 5,293,522 | A | 5/1994 | Fello |
| 5,363,269 | A | 11/1994 | McDonald |
| 5,418,678 | A | 5/1995 | McDonald |
| 5,448,443 | A | 9/1995 | Muelleman |
| 5,477,412 | A | 12/1995 | Neiger et al. |
| 5,510,760 | A | 4/1996 | Marcou et al. |
| 5,515,218 | A | 5/1996 | DeHaven |
| 5,517,165 | A | 5/1996 | Cook |
| 5,541,800 | A | 7/1996 | Misencik |
| 5,576,580 | A | 11/1996 | Hosoda et al. |
| 5,594,398 | A | 1/1997 | Marcou et al. |
| 5,600,524 | A | 2/1997 | Neiger et al. |
| 5,654,857 | A | 8/1997 | Gershen |
| 5,655,648 | A | 8/1997 | Rosen |
| 5,661,623 | A | 8/1997 | McDonald et al. |
| 5,680,287 | A | 10/1997 | Gernhardt |
| 5,694,280 | A | 12/1997 | Zhou |
| 5,706,155 | A | 1/1998 | Neiger et al. |
| 5,710,399 | A | 1/1998 | Castonguay et al. |
| 5,715,125 | A | 2/1998 | Neiger |
| 5,729,417 | A | 3/1998 | Neiger et al. |
| 5,805,397 | A | 9/1998 | MacKenzie |
| 5,815,363 | A | 9/1998 | Chu |
| 5,825,602 | A | 10/1998 | Tosaka et al. |
| 5,844,765 | A | 12/1998 | Kato et al. |
| 5,877,925 | A | 3/1999 | Singer |
| 5,917,686 | A | 6/1999 | Chan |
| 5,920,451 | A | 7/1999 | Fasano et al. |
| 5,933,063 | A | 8/1999 | Keung et al. |
| 5,943,198 | A | 8/1999 | Hirsh et al. |
| 5,950,812 | A | 9/1999 | Tanacan et al. |
| 5,956,218 | A | 9/1999 | Berthold |
| 6,021,034 | A | 2/2000 | Chan et al. |
| 6,040,967 | A | 3/2000 | DiSalvo |
| 6,052,265 | A | 4/2000 | Zaretsky et al. |
| 6,180,899 | B1 | 1/2001 | Passow |
| 6,204,743 | B1 | 3/2001 | Greenberg et al. |
| 6,226,161 | B1 | 5/2001 | Neiger et al. |
| 6,232,857 | B1 | 5/2001 | Mason, Jr. et al. |
| 6,242,993 | B1 | 6/2001 | Fleege et al. |
| 6,246,558 | B1 | 6/2001 | DiSalvo et al. |
| 6,252,407 | B1 | 6/2001 | Gershen |
| 6,255,923 | B1 | 7/2001 | Mason, Jr. et al. |
| 6,259,340 | B1 | 7/2001 | Fuhr et al. |
| 6,282,070 | B1 | 8/2001 | Ziegler et al. |
| 6,288,882 | B1 | 9/2001 | DiSalvo et al. |
| 6,381,112 | B1 | 4/2002 | DiSalvo |
| 6,381,113 | B1 | 4/2002 | Legatti |
| 6,545,574 | B1 | 4/2003 | Seymour et al. |
| 6,580,344 | B2 | 6/2003 | Li |
| 6,590,753 | B1 | 7/2003 | Finlay |
| 6,642,823 | B2 | 11/2003 | Passow |
| 6,657,834 | B2 | 12/2003 | DiSalvo |
| 6,850,394 | B2 | 2/2005 | Kim |
| 6,864,766 | B2 | 3/2005 | DiSalvo et al. |
| 6,930,574 | B2 | 8/2005 | Gao |
| 6,954,125 | B2 | 10/2005 | Wu et al. |
| 6,958,895 | B1 | 10/2005 | Radosavljevic et al. |
| 6,980,005 | B2 | 12/2005 | Finlay, Sr. et al. |
| 6,998,945 | B2 | 2/2006 | Huang et al. |
| 7,116,191 | B2 | 10/2006 | Wang |
| 7,149,065 | B2 | 12/2006 | Baldwin et al. |
| 7,170,375 | B2 | 1/2007 | Chen et al. |
| 7,173,799 | B1 | 2/2007 | Weeks et al. |
| 7,195,500 | B2 | 3/2007 | Huang et al. |
| 7,211,758 | B2 | 5/2007 | Lui |
| 7,265,956 | B2 | 9/2007 | Huang |
| 7,289,306 | B2 | 10/2007 | Huang |
| 7,295,415 | B2 | 11/2007 | Huang et al. |
| 7,315,227 | B2 | 1/2008 | Huang et al. |
| 7,317,600 | B2 | 1/2008 | Huang et al. |
| 7,400,477 | B2 | 7/2008 | Campolo et al. |
| 7,403,086 | B2 | 7/2008 | Wu et al. |
| 7,411,766 | B1 | 8/2008 | Huang et al. |
| 7,515,024 | B2 | 4/2009 | Chen et al. |
| 7,525,402 | B2 | 4/2009 | Gao |
| 7,538,993 | B2 | 5/2009 | Huang et al. |
| 7,737,809 | B2 | 6/2010 | Germain et al. |
| 2004/0201438 | A1 | 10/2004 | Gao |
| 2005/0140476 | A1 | 6/2005 | Gao |

FOREIGN PATENT DOCUMENTS

| | | |
|---|---|---|
| DE | 3431 581 C2 | 11/1991 |
| DE | 3341581 | 11/1991 |
| EP | 081661 | 6/1983 |
| ES | 21345 8/77 | 5/1978 |
| FR | 2391549 | 12/1978 |
| GB | 227930 | 1/1925 |
| GB | 830018 | 9/1960 |
| GB | 2207823 | 8/1989 |
| GB | 2292491 | 2/1996 |
| JP | 61-259428 | 11/1986 |

OTHER PUBLICATIONS

Ground Fault Circuit Interruper, Issue No. B-463016, 20 AMP 2 Pole Unit, 120 Vac, Pass & Seymour, Inc.

Leviton's Opposition to Defendants' Summary Judgement Motion on Infringement re: '558 Patent, Civil Action No. 04-0424 JB/LFG, Apr. 12, 2007.

*Leviton Mfg. Co., Inc.* v. *Universal Security Instruments, Inc.* and *USI Elec/Shanghai* v. *Leviton*, CAFC, 2009-1421 (May 28, 2010).

*General Protecht Grp, Inc.* v. *Leviton Mfg. Co., Inc.*, Complaint for Declaratory and Injunctive Relief, US District Court, District of NM (Oct. 28, 2010).

Certain Ground Fault Circuit Interrupters and Products Containing the Same, Response to Verified Amended Complaint, US Int'l Trade comm. Wash, DC, Inv. No. 337-TA-739 (Nov. 4, 2010).

10
12
14
16
18
20
21
22
24
26
28
30
32
34
36
RESET
TEST 24
30
RESET
114
112
110
120
120
102
100
26
TEST
100
102
118
82
72
38
70
96
96
98
98
93
92
94
50
62
52
116
34
84
74
40
78
80
60
58
54
64
60
36

CIRCUIT INTERRUPTING DEVICE WITH REVERSE WIRING PROTECTION

This application is a continuation-in-part of an application having application Ser. No. 10/692,056 filed on Oct. 22, 2003, now U.S. Pat. No. 7,049,911 which issued on May 23, 2006, which claims priority to a provisional application having Provisional Application No. 60/444,469 filed on Feb. 3, 2003. This application is also a continuation-in-part application of an application having application Ser. No. 10/690,776 filed on Oct. 22, 2003, now U.S. Pat. No. 7,737,809 which issued on Jun. 15, 2010, which claims priority to a provisional application having Provisional Application No. 60/444,469 filed Feb. 3, 2003.

BACKGROUND

1. Field

The present application is directed to reset lockout devices including resettable circuit interrupting devices and systems such as ground fault circuit interrupters (GFCI's), arc fault circuit interrupters (AFCI's), immersion detection circuit interrupters (IDCI's), appliance leakage circuit interrupters (ALCI's), equipment leakage circuit interrupters (ELCI's), circuit breakers, contactors, latching relays and solenoid mechanisms.

2. Description of the Related Art

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. Presently available GFCI devices, such as the device described in commonly owned U.S. Pat. No. 4,595,894, use an electrically activated trip mechanism to mechanically break an electrical connection between the line side and the load side. Such devices are resettable after they are tripped by, for example, the detection of a ground fault. In the device discussed in the '894 patent, the trip mechanism used to cause the mechanical breaking of the circuit (i.e., the conductive path between the line and load sides) includes a solenoid (or trip coil). A test button is used to test the trip mechanism and circuitry used to sense faults, and a reset button is used to reset the electrical connection between line and load sides.

However, instances may arise where an abnormal condition, caused by for example a lightning strike, occurs which may result not only in a surge of electricity at the device and a tripping of the device but also a disabling of the trip mechanism used to cause the mechanical breaking of the circuit. This may occur without the knowledge of the user. Under such circumstances an unknowing user, faced with a GFCI which has tripped, may press the reset button which, in turn, will cause the device with an inoperative trip mechanism to be reset without the ground fault protection available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, current GFCI devices, which have tripped, may be reset even though the open neutral condition may remain.

Commonly owned application Ser. No. 09/138,955, filed Aug. 24, 1998, which is incorporated herein in its entirety by reference, describes a family of resettable circuit interrupting devices capable of locking out the reset portion of the device if the circuit interrupting portion is non-operational or if an open neutral condition exists. Commonly owned application Ser. No. 09/175,228, filed Sep. 20, 1998, which is incorporated herein in its entirety by reference, describes a family of resettable circuit interrupting devices capable of locking out the reset portion of the device if the circuit interrupting portion is non-operational or if an open neutral condition exists and capable of breaking electrical conductive paths independent of the operation of the circuit interrupting portion.

Some of the circuit interrupting devices described above have a user accessible load side connection in addition to the line and load side connections. The user accessible load side connection includes one or more connection points where a user can externally connect to electrical power supplied from the line side. The load side connection and user accessible load side connection are typically electrically connected together. An example of such a circuit interrupting device is a GFCI receptacle, where the line and load side connections are binding screws and the user accessible load side connection is the plug connection. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load connection. This is known as reverse wiring. In the event the circuit interrupting device is reverse wired, fault protection to the user accessible load connection may be eliminated, even if fault protection to the load side connection remains.

SUMMARY

The present application relates to a family of resettable circuit interrupting devices that maintains fault protection for the circuit interrupting device even if the device is reverse wired.

In one embodiment, the circuit interrupting device includes a housing and phase and neutral conductive paths disposed at least partially within the housing between line and load sides. Preferably, the phase conductive path terminates at a first connection capable of being electrically connected to a source of electricity, a second connection capable of conducting electricity to at least one load and a third connection capable of conducting electricity to at least one user accessible load. Similarly, the neutral conductive path, preferably, terminates at a first connection capable of being electrically connected to a source of electricity, a second connection capable of providing a neutral connection to the at least one load and a third connection capable of providing a neutral connection to the at least one user accessible load.

The circuit interrupting device also includes a circuit interrupting portion that is disposed within the housing and configured to cause electrical discontinuity in one or both of the phase and neutral conductive paths, between said line side and said load side upon the occurrence of a predetermined condition. A reset portion is disposed at least partially within the housing and is configured to reestablish electrical continuity in the open conductive paths.

Preferably, the phase conductive path includes a plurality of contacts that are capable of opening to cause electrical discontinuity in the phase conductive path and closing to reestablish electrical continuity in the phase conductive path, between said line and load sides. The neutral conductive path also includes a plurality of contacts that are capable of opening to cause electrical discontinuity in the neutral conductive path and closing to reestablish electrical continuity in the neutral conductive path, between said line and load sides. In this configuration, the circuit interrupting portion causes the plurality of contacts of the phase and neutral conductive paths to open, and the reset portion causes the plurality of contacts of the phase and neutral conductive paths to close.

One embodiment for the circuit interrupting portion uses an electromechanical circuit interrupter to cause electrical discontinuity in the phase and neutral conductive paths, and sensing circuitry to sense the occurrence of the predetermined condition. For example, the electromechanical circuit interrupter include a coil assembly, a movable plunger attached to the coil assembly and a banger attached to the plunger. The movable plunger is responsive to energizing of the coil assembly, and movement of the plunger is translated to movement of said banger. Movement of the banger causes the electrical discontinuity in the phase and/or neutral conductive paths.

The circuit interrupting device may also include reset lockout portion that prevents the reestablishing of electrical continuity in either the phase or neutral conductive path or both conductive paths, unless the circuit interrupting portion is operating properly. That is, the reset lockout prevents resetting of the device unless the circuit interrupting portion is operating properly. In embodiments where the circuit interrupting device includes a reset lockout portion, the reset portion may be configured so that at least one reset contact is electrically connected to the sensing circuitry of the circuit interrupting portion, and that depression of a reset button causes at least a portion of the phase conductive path to contact at least one reset contact. When contact is made between the phase conductive path and the at least one reset contact, the circuit interrupting portion is activated so that the reset lockout portion is disabled and electrical continuity in the phase and neutral conductive paths can be reestablished.

The circuit interrupting device may also include a trip portion that operates independently of the circuit interrupting portion. The trip portion is disposed at least partially within the housing and is configured to cause electrical discontinuity in the phase and/or neutral conductive paths independent of the operation of the circuit interrupting portion. In one embodiment, the trip portion includes a trip actuator accessible from an exterior of the housing and a trip arm preferably within the housing and extending from the trip actuator. The trip arm is preferably configured to facilitate mechanical breaking of electrical continuity in the phase and/or neutral conductive paths, if the trip actuator is actuated. Preferably, the trip actuator is a button. However, other known actuators are also contemplated.

BRIEF DESCRIPTION OF THE DRAWINGS

Preferred embodiments of the present application are described herein with reference to the drawings in which similar elements are given similar reference characters, wherein.

DETAILED DESCRIPTION

Figure 1:
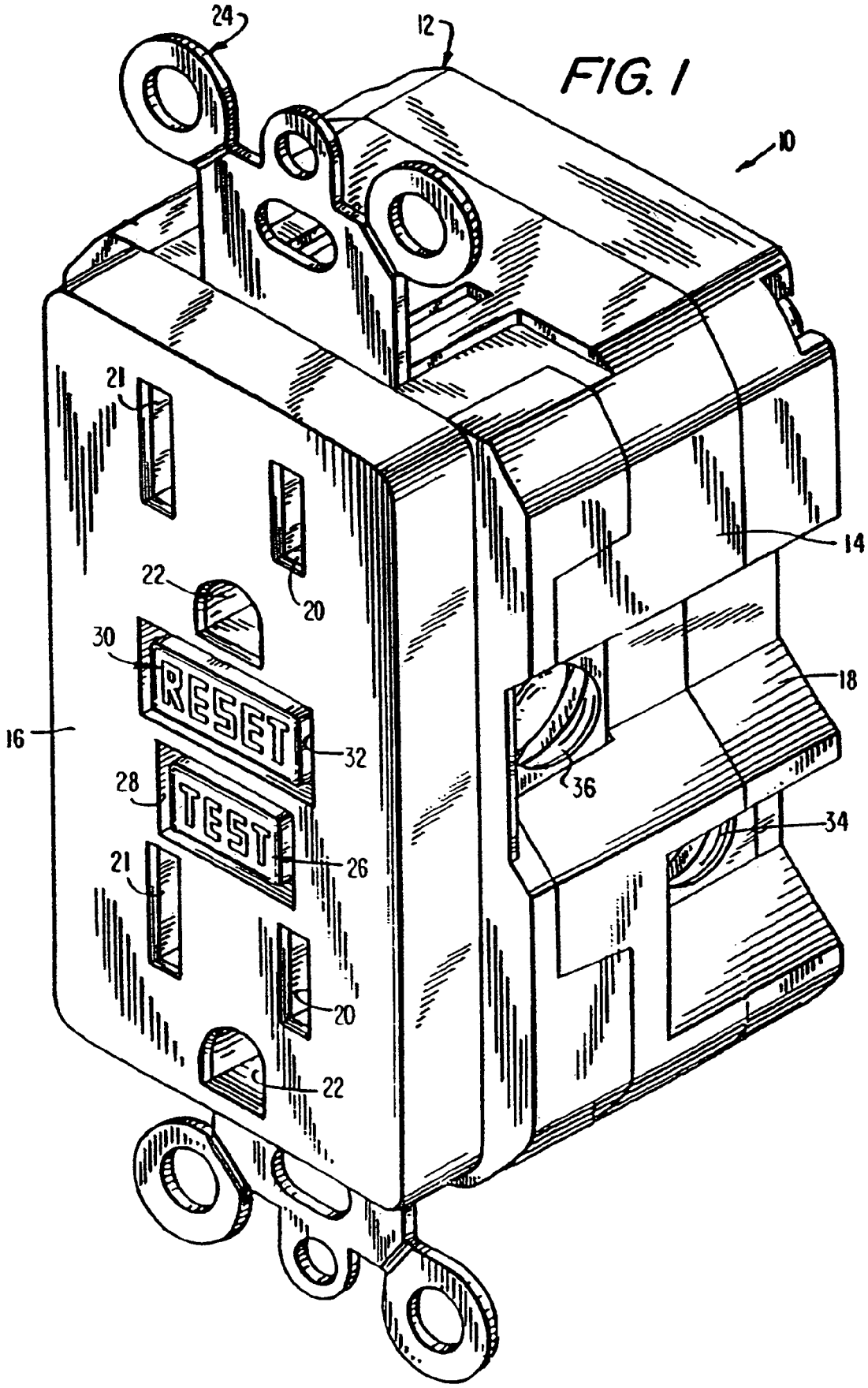
FIG. 1 is a perspective view of one embodiment of a ground fault circuit interrupting device according to the present application.

The present application contemplates various types of circuit interrupting devices that are capable of breaking at least one conductive path at both a line side and a load side of the device. The conductive path is typically divided between a line side that connects to supplied electrical power and a load side that connects to one or more loads. As noted, the various devices in the family of resettable circuit interrupting devices include: ground fault circuit interrupters (GFCI's), arc fault circuit interrupters (AFCI's), immersion detection circuit interrupters (IDCI's), appliance leakage circuit interrupters (ALCI's) and equipment leakage circuit interrupters (ELCI's).

For the purpose of the present application, the structure or mechanisms used in the circuit interrupting devices, shown in the drawings and described hereinbelow, are incorporated into a GFCI receptacle suitable for installation in a single-gang junction box used in, for example, a residential electrical wiring system. However, the mechanisms according to the present application can be included in any of the various devices in the family of resettable circuit interrupting devices.

The GFCI receptacles described herein have line and load phase (or power) connections, line and load neutral connections and user accessible load phase and neutral connections. The connections permit external conductors or appliances to be connected to the device. These connections may be, for example, electrical fastening devices that secure or connect external conductors to the circuit interrupting device, as well as conduct electricity. Examples of such connections include binding screws, lugs, terminals and external plug connections.

In one embodiment, the GFCI receptacle has a circuit interrupting portion, a reset portion and a reset lockout. This embodiment is shown in FIGS. 1-12. In another embodiment, the GFCI receptacle is similar to the embodiment of FIGS. 1-12, except the reset lockout is omitted. Thus, in this embodiment, the GFCI receptacle has a circuit interrupting portion and a reset portion, which is similar to those described in FIGS. 1-12. In another embodiment, the GFCI receptacle has a circuit interrupting portion, a reset portion, a reset lockout and an independent trip portion. This embodiment is shown in FIGS. 13-20.

In yet another embodiment (see FIG. 12A), the GFCI receptacle has a movable bridge contact that is floating allowing the line terminals, load terminals and user accessible terminals (i.e., face terminals) to be electrically isolated from each other when the GFCI is tripped; the electrical isolation between these terminals is complete in that there are no conductive paths electrically connecting any terminal to any other terminal when the GFCI device has been tripped.

In yet a further embodiment (see FIGS. 12D, 12E) the GFCI receptacle is designed so that the line, load and face terminals are positioned in a fashion allowing them to electrically connect to each other when at least one of them is engaged by an actuator.

The circuit interrupting and reset portions described herein preferably use electro-mechanical components to break (open) and make (close) one or more conductive paths between the line and load sides of the device. However, electrical components, such as solid state switches and supporting circuitry, may be used to open and close the conductive paths.

Generally, the circuit interrupting portion is used to automatically break electrical continuity in one or more conductive paths (i.e., open the conductive path) between the line and load sides upon the detection of a fault, which in the embodiments described is a ground fault. The reset portion is used to close the open conductive paths.

In the embodiments including a reset lockout, the reset portion is used to disable the reset lockout, in addition to closing the open conductive paths. In this configuration, the operation of the reset and reset lockout portions is in conjunction with the operation of the circuit interrupting portion, so that electrical continuity in open conductive paths cannot be reset if the circuit interrupting portion is non-operational, if an open neutral condition exists and/or if the device is reverse wired.

In the embodiments including an independent trip portion, electrical continuity in one or more conductive paths can be broken independently of the operation of the circuit interrupting portion. Thus, in the event the circuit interrupting portion is not operating properly, the device can still be tripped.

The above-described features can be incorporated in any resettable circuit interrupting device, but for simplicity the descriptions herein are directed to GFCI receptacles.

Turning now to FIG. 1, the GFCI receptacle 10 has a housing 12 consisting of a relatively central body 14 to which a face or cover portion 16 and a rear portion 18 are removably secured. The face portion 16 has entry ports 20 and 21 for receiving normal or polarized prongs of a male plug of the type normally found at the end of a lamp or appliance cord set (not shown), as well as ground-prong-receiving openings 22 to accommodate a three-wire plug. The receptacle also includes a mounting strap 24 used to fasten the receptacle to a junction box.

A test button 26 extends through opening 28 in the face portion 16 of the housing 12. The test button is used to activate a test operation, that tests the operation of the circuit interrupting portion (or circuit interrupter) disposed in the device. The circuit interrupting portion, to be described in more detail below, is used to break electrical continuity in one or more conductive paths between the line and load side of the device. A reset button 30 forming a part of the reset portion extends through opening 32 in the face portion 16 of the housing 12. The reset button is used to activate a reset operation, which reestablishes electrical continuity in the open conductive paths.

Electrical connections to existing household electrical wiring are made via binding screws 34 and 36, where screw 34 is an input (or line) phase connection, and screw 36 is an output (or load) phase connection. It should be noted that two additional binding screws 38 and 40 (seen in FIG. 3) are located on the opposite side of the receptacle 10. These additional binding screws provide line and load neutral connections, respectively. A more detailed description of a GFCI receptacle is provided in U.S. Pat. No. 4,595,894, which is incorporated herein in its entirety by reference. It should also be noted that binding screws 34, 36, 38 and 40 are exemplary of the types of wiring terminals that can be used to provide the electrical connections. Examples of other types of wiring terminals include set screws, pressure clamps, pressure plates, push-in type connections, pigtails and quick-connect tabs.

Referring to FIGS. 2-6, the conductive path between the line phase connection 34 and the load phase connection 36 includes contact arm 50 which is movable between stressed and unstressed positions, movable contact 52 mounted to the contact arm 50, contact arm 54 secured to or monolithically formed into the load phase connection 36 and fixed contact 56 mounted to the contact arm 54. The user accessible load phase connection for this embodiment includes terminal assembly 58 having two binding terminals 60 which are capable of engaging a prong of a male plug inserted therebetween. The conductive path between the line phase connection 34 and the user accessible load phase connection includes, contact arm 50, movable contact 62 mounted to contact arm 50, contact arm 64 secured to or monolithically formed into terminal assembly 58, and fixed contact 66 mounted to contact arm 64. These conductive paths are collectively called the phase conductive path.

Similarly, the conductive path between the line neutral connection 38 and the load neutral connection 40 includes, contact arm 70 which is movable between stressed and unstressed positions, movable contact 72 mounted to contact arm 70, contact arm 74 secured to or monolithically formed into load neutral connection 40, and fixed contact 76 mounted to the contact arm 74. The user accessible load neutral connection for this embodiment includes terminal assembly 78 having two binding terminals 80 which are capable of engaging a prong of a male plug inserted therebetween. The conductive path between the line neutral connection 38 and the user accessible load neutral connection includes, contact arm 70, movable contact 82 mounted to the contact arm 70, contact arm 84 secured to or monolithically formed into terminal assembly 78, and fixed contact 86 mounted to contact arm 84. These conductive paths are collectively called the neutral conductive path.

Figure 2:
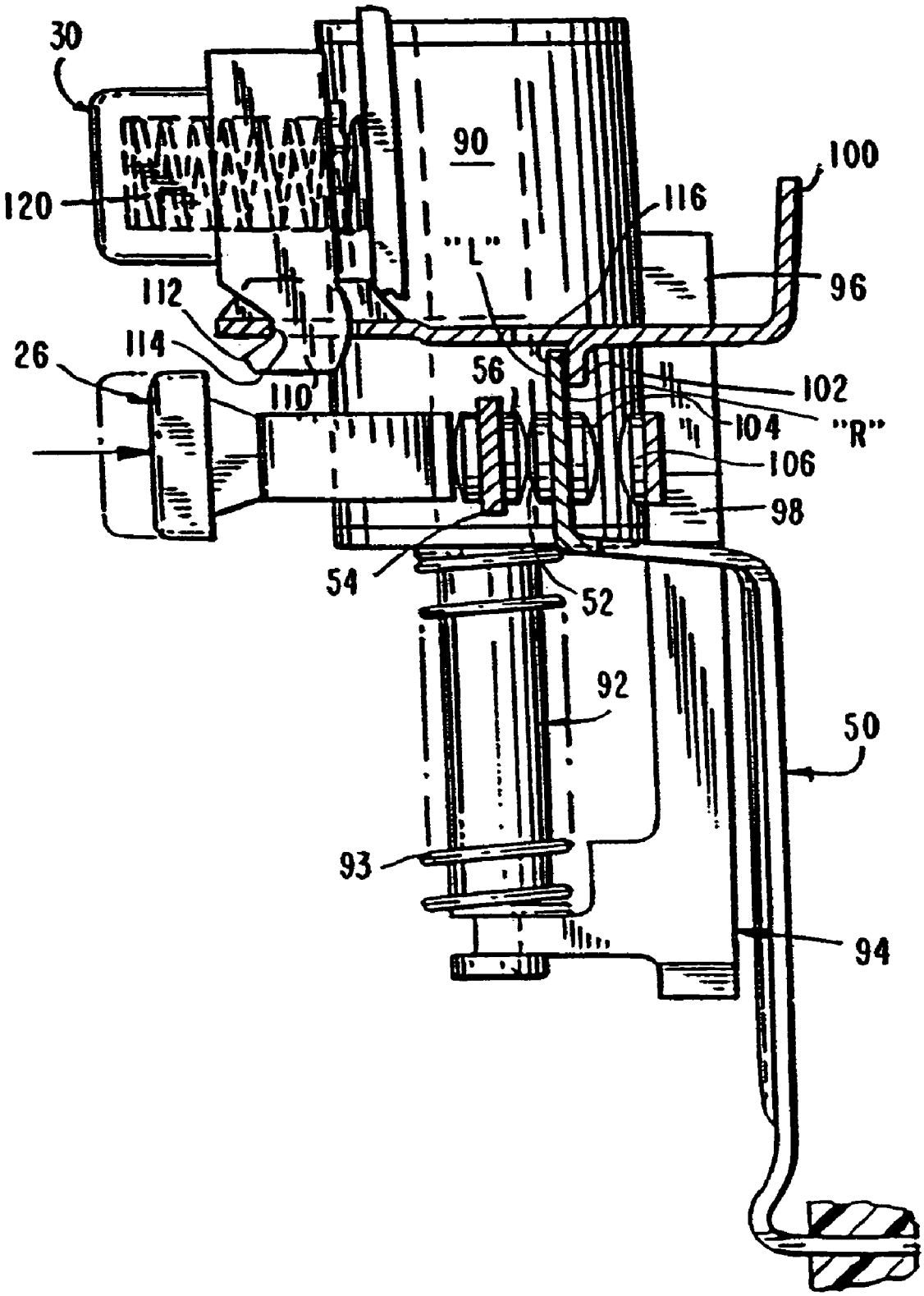
FIG. 2 is side elevational view, partly in section, of a portion of the GFCI device shown in FIG. 1, illustrating the GFCI device in a set or circuit making position.
Figure 12:
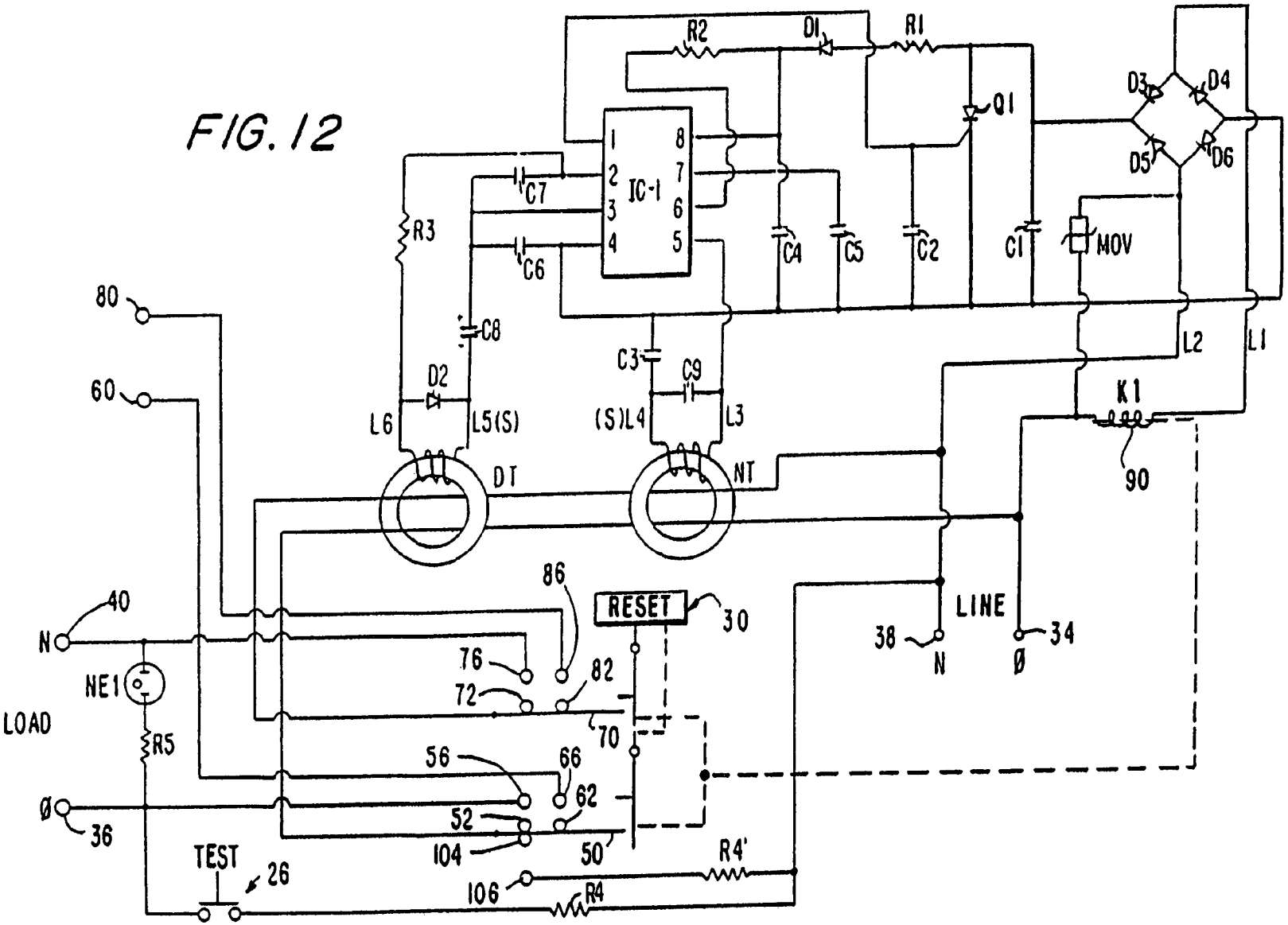
FIG. 12 is a schematic diagram of a circuit for detecting ground faults and resetting the GFCI device of FIG. 1.

Referring to FIG. 2, the circuit interrupting portion has a circuit interrupter and electronic circuitry capable of sensing faults, e.g., current imbalances, on the hot and/or neutral conductors. In a preferred embodiment for the GFCI receptacle, the circuit interrupter includes a coil assembly 90, a plunger 92 responsive to the energizing and de-energizing of the coil assembly and a banger 94 connected to the plunger 92. The banger 94 has a pair of banger dogs 96 and 98 which interact with a movable latching members 100 used to set and reset electrical continuity in one or more conductive paths. The coil assembly 90 is activated in response to the sensing of a ground fault by, for example, the sense circuitry shown in FIG. 12. FIG. 12 shows conventional circuitry for detecting ground faults that includes a differential transformer that senses current imbalances.

The reset portion includes reset button 30, the movable latching members 100 connected to the reset button 30, latching fingers 102 and reset contacts 104 and 106 that temporarily activate the circuit interrupting portion when the reset button is depressed, when in the tripped position. Preferably, the reset contacts 104 and 106 are normally open momentary contacts. The latching fingers 102 are used to engage side R of each contact arm 50,70 and move the arms 50,70 back to the stressed position where contacts 52,62 touch contacts 56,66, respectively, and where contacts 72,82 touch contacts 76,86, respectively.

The movable latching members 102 are, in this embodiment, common to each portion (i.e., the circuit interrupting, reset and reset lockout portions) and used to facilitate making, breaking or locking out of electrical continuity of one or more of the conductive paths. However, the circuit interrupting devices according to the present application also contemplate embodiments where there is no common mechanism or member between each portion or between certain portions. Further, the present application also contemplates using circuit interrupting devices that have circuit interrupting, reset and reset lockout portions to facilitate making, breaking or locking out of the electrical continuity of one or both of the phase or neutral conductive paths.

Figure 3:
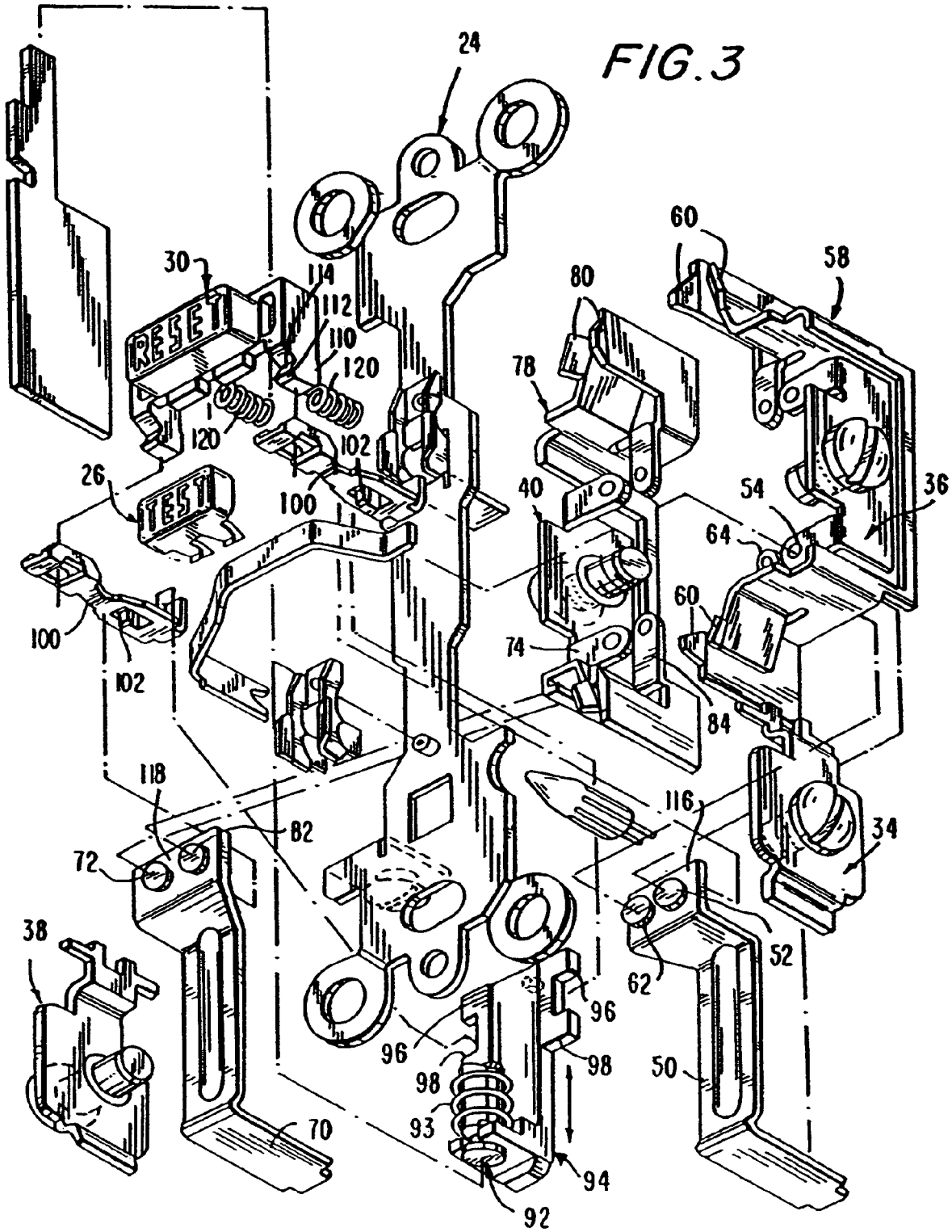
FIG. 3 is an exploded view of internal components of the circuit interrupting device of FIG. 1.

In the embodiment shown in FIGS. 2 and 3, the reset lockout portion includes latching fingers 102 which after the device is tripped, engages side L of the movable arms 50,70 so as to block the movable arms 50,70 from moving. By blocking movement of the movable arms 50,70, contacts 52 and 56, contacts 62 and 66, contacts 72 and 76 and contacts 82 and 86 are prevented from touching. Alternatively, only one of the movable arms 50 or 70 may be blocked so that their respective contacts are prevented from touching. Further, in this embodiment, latching fingers 102 act as an active inhibitor that prevents the contacts from touching. Alternatively, the natural bias of movable arms 50 and 70 can be used as a passive inhibitor that prevents the contacts from touching.

Referring now to FIGS. 2 and 7-11, the mechanical components of the circuit interrupting and reset portions in various stages of operation are shown. For this part of the description, the operation will be described only for the phase conductive path, but the operation is similar for the neutral conductive path, if it is desired to open and close both conductive paths. In FIG. 2, the GFCI receptacle is shown in a set position where movable contact arm 50 is in a stressed condition so that movable contact 52 is in electrical engagement with fixed contact 56 of contact arm 54. If the sensing circuitry of the GFCI receptacle senses a ground fault, the coil assembly 90 is energized to draw plunger 92 into the coil assembly 90 so that banger 94 moves upwardly. As the banger moves upwardly, the banger front dog 98 strikes the latch member 100 causing it to pivot in a counterclockwise direction C (seen in FIG. 7) about the joint created by the top edge 112 and inner surface 114 of finger 110. The movement of the latch member 100 removes the latching finger 102 from engagement with side R of the remote end 116 of the movable contact arm 50, and permits the contact arm 50 to return to its pre-stressed condition opening contacts 52 and 56, seen in FIG. 7.

Figure 10:
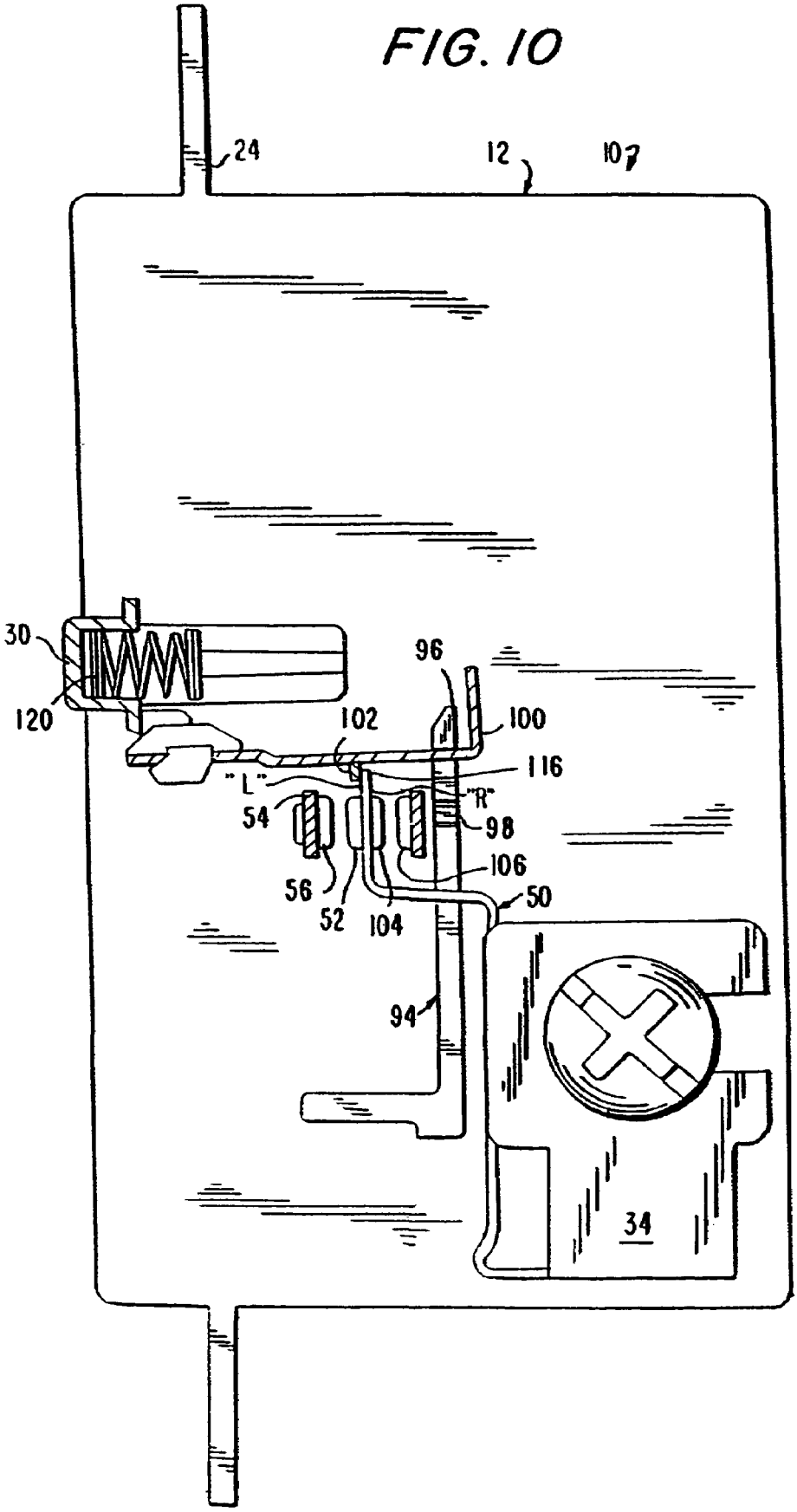

After tripping, the coil assembly 90 is de-energized so that spring 93 returns plunger 92 to its original extended position and banger 94 moves to its original position releasing latch member 100. At this time, the latch member 100 is in a lockout position where latch finger 102 inhibits movable contact 52 from engaging fixed contact 56, as seen in FIG. 10. As noted, one or both latching fingers 102 can act as an active inhibitor that prevents the contacts from touching. Alternatively, the natural bias of movable arms 50 and 70 can be used as a passive inhibitor that prevents the contacts from touching.

Figure 7:
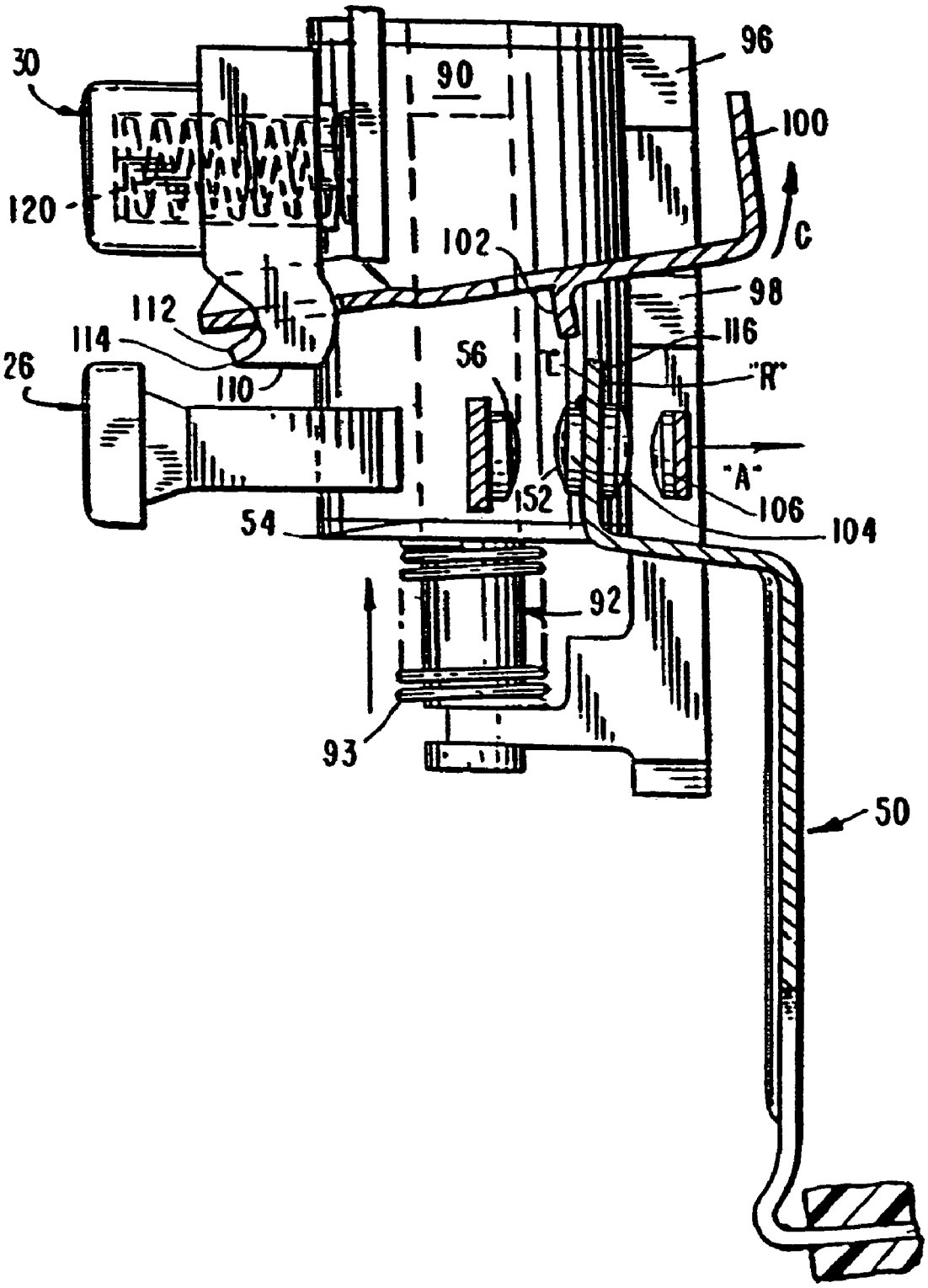
FIG. 7 is a side elevational view similar to FIG. 2, illustrating the GFCI device in a circuit breaking or interrupting position.
Figure 8:
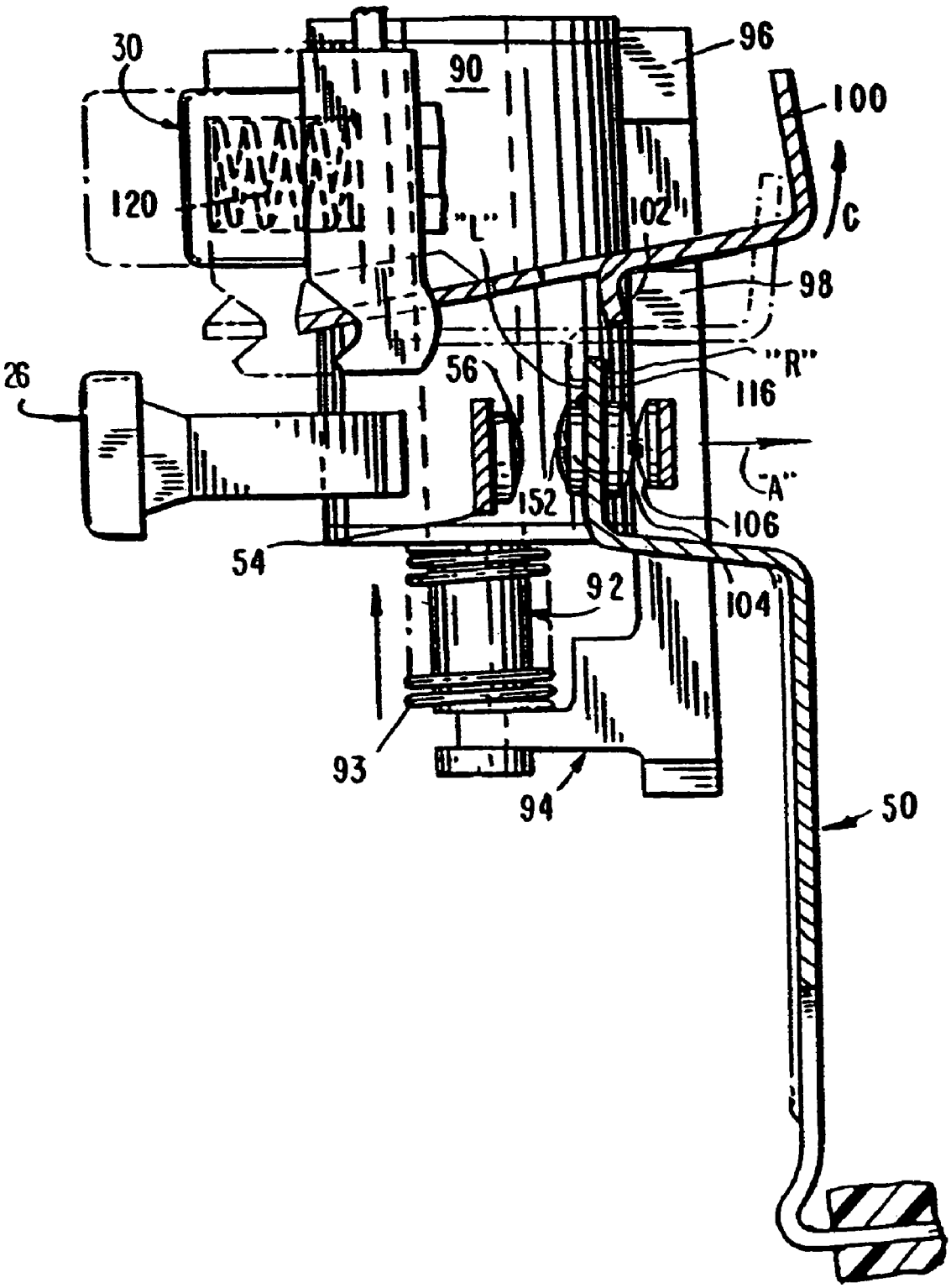
FIG. 8 is a side elevational view similar to FIG. 2, illustrating the components of the GFCI device during a reset operation.
Figure 11:
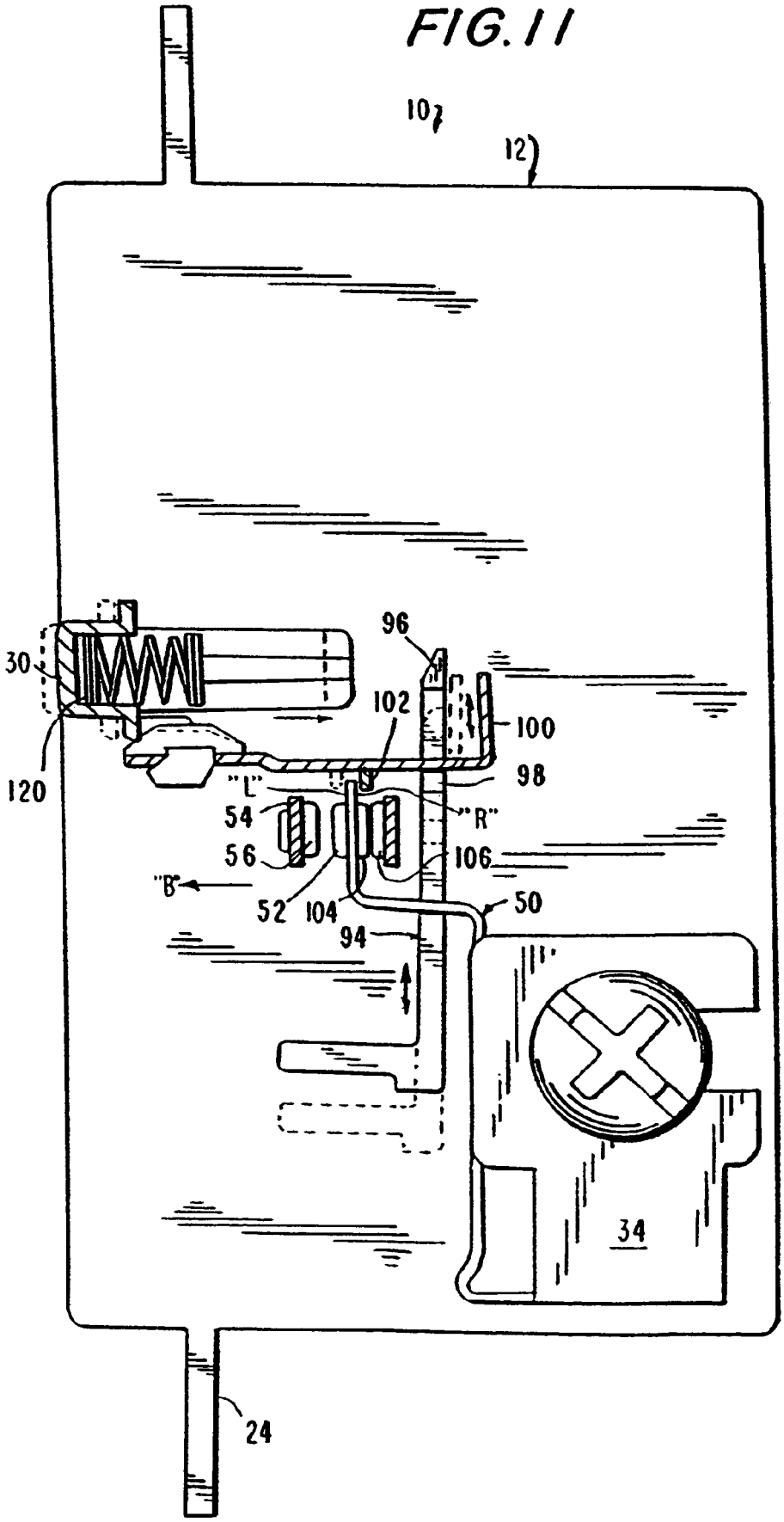

To reset the GFCI receptacle so that contacts 52 and 56 are closed and continuity in the phase conductive path is reestablished, the reset button 30 is depressed sufficiently to overcome the bias force of return spring 120 and move the latch member 100 in the direction of arrow A, seen in FIG. 8. While the reset button 30 is being depressed, latch finger 102 contacts side L of the movable contact arm 50 and continued depression of the reset button 30 forces the latch member to overcome the stress force exerted by the arm 50 causing the reset contact 104 on the arm 50 to close on reset contact 106. Closing the reset contacts activates the operation of the circuit interrupter by, for example simulating a fault, so that plunger 92 moves the banger 94 upwardly striking the latch member 100 which pivots the latch finger 102, while the latch member 100 continues to move in the direction of arrow A. As a result, the latch finger 102 is lifted over side L of the remote end 116 of the movable contact arm 50 onto side R of the remote end of the movable contact arm, as seen in FIGS. 7 and 11. Contact arm 50 returns to its unstressed position, opening contacts 52 and 56 and contacts 62 and 66, so as to terminate the activation of the circuit interrupting portion, thereby de-energizing the coil assembly 90.

Figure 9:
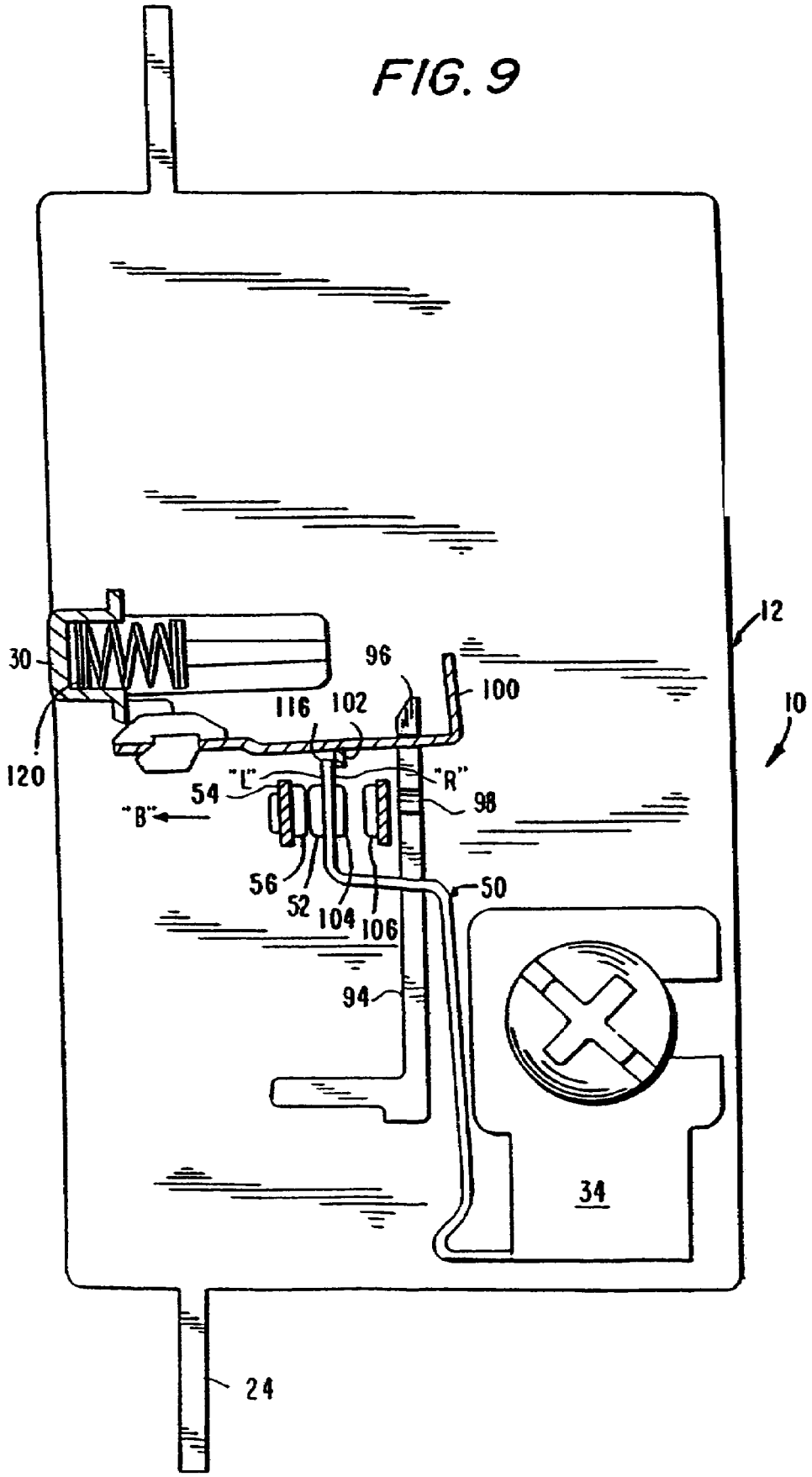
FIGS. 9-11 are schematic representations of the operation of one embodiment of the reset portion of the present application, illustrating a latching member used to make an electrical connection between line and load connections and to relate the reset portion of the electrical connection with the operation of the circuit interrupting portion.

After the circuit interrupter operation is activated, the coil assembly 90 is de-energized so that so that plunger 92 returns to its original extended position, and banger 94 releases the latch member 100 so that the latch finger 102 is in a reset position, seen in FIG. 9. Release of the reset button causes the latching member 100 and movable contact arm 50 to move in the direction of arrow B (seen in FIG. 9) until contact 52 electrically engages contact 56, as seen in FIG. 2.

As noted above, if opening and closing of electrical continuity in the neutral conductive path is desired, the above description for the phase conductive path is also applicable to the neutral conductive path.

In an alternative embodiment, the circuit interrupting devices may also include a trip portion that operates independently of the circuit interrupting portion so that in the event the circuit interrupting portion becomes non-operational the device can still be tripped. Preferably, the trip portion is manually activated and uses mechanical components to break one or more conductive paths. However, the trip portion may use electrical circuitry and/or electromechanical components to break either the phase or neutral conductive path or both paths.

For the purposes of the present application, the structure or mechanisms for this embodiment are also incorporated into a GFCI receptacle, seen in FIGS. 13-20, suitable for installation in a single-gang junction box in a home. However, the mechanisms according to the present application can be included in any of the various devices in the family of resettable circuit interrupting devices.

Figure 12A:
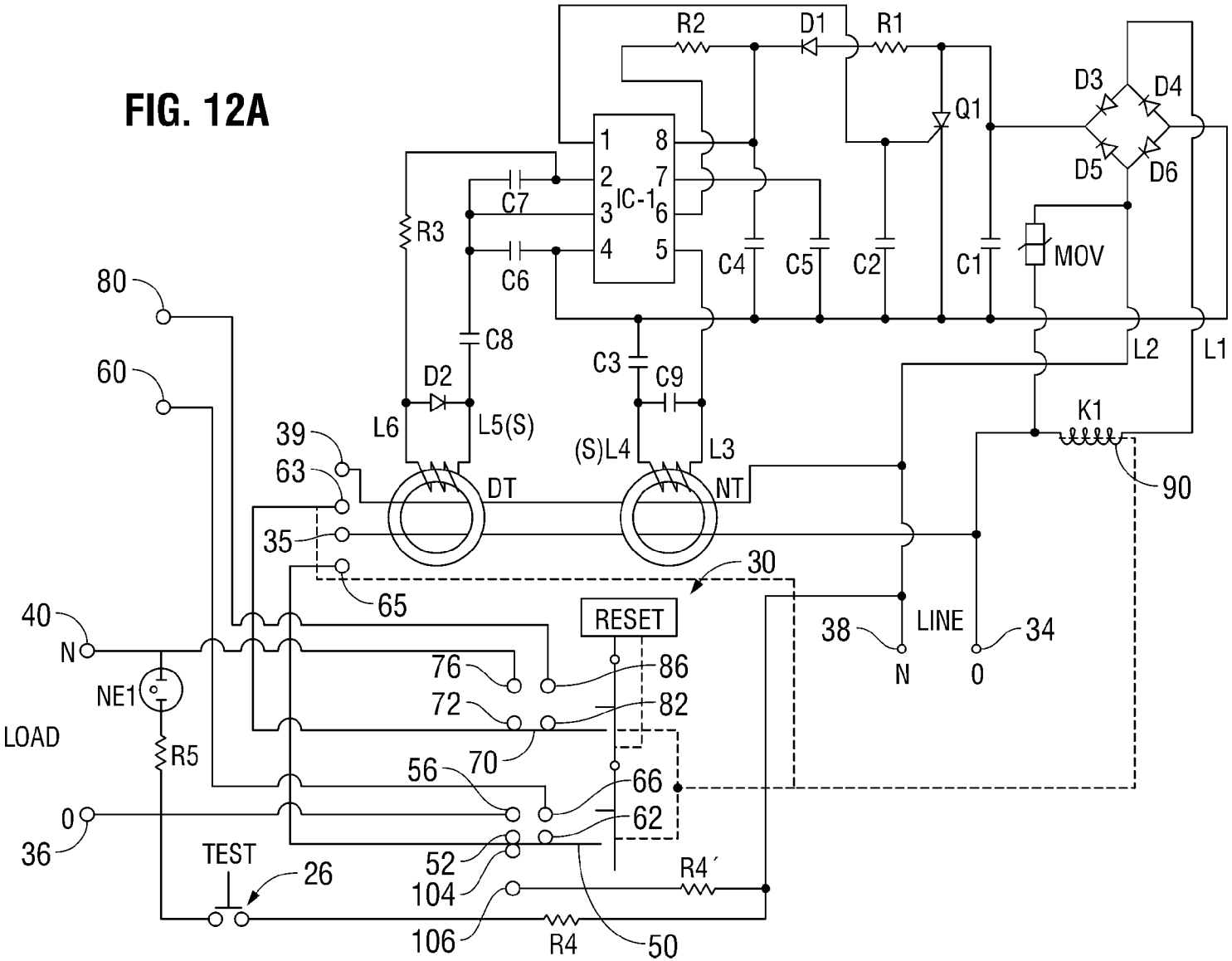
FIG. 12A is a schematic diagram of a circuit for detecting ground faults and resetting the GFCI of FIG. 1 using floating movable bridges.
Figure 12B:
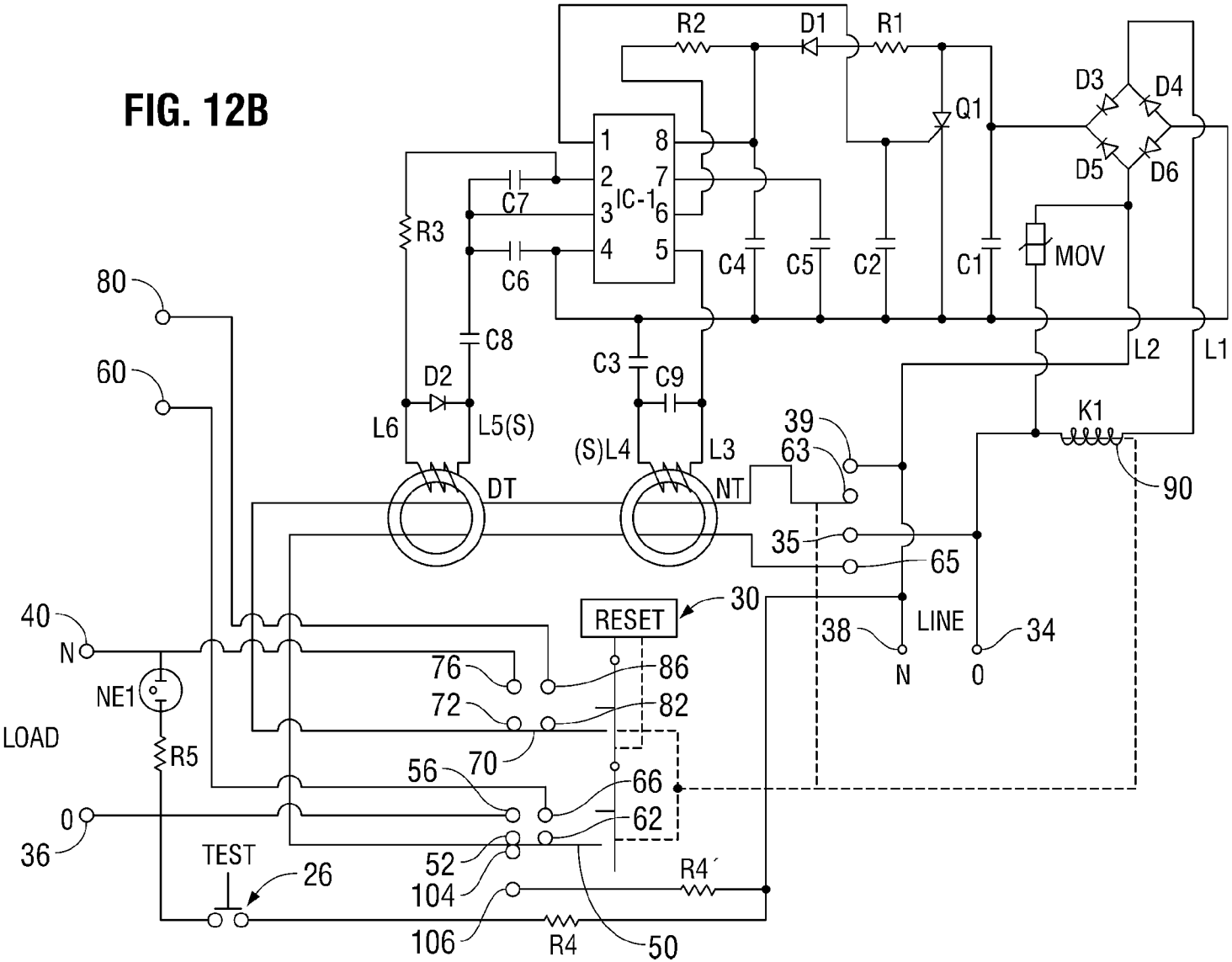
FIG. 12B is another schematic diagram of a circuit for detecting ground faults and resetting the GFCI of FIG. 1 using floating movable bridges.

FIG. 12A shows the schematic of a GFCI device using movable floating bridges that electrically connect the line terminals (34, 38) to the load terminals (36, 40) and user accessible terminals (also referred to as face terminals) (60, 80). Movable arms 50 and 70 are now movable floating bridges in that they are not permanently electrically connected to any of the terminals. When the GFCI device is tripped (or is in a tripped condition) as shown in FIG. 12A, movable contacts 52, 62 and 65 of movable bridge 50 are electrically isolated from load contact 56, face contact 66 and line terminal contact 35. Similarly, movable contacts 72, 82 and 63 of movable bridge 70 are electrically isolated from load contact 76, face contact 86 and line terminal contact 39 when the GFCI device is tripped. There are no conductive paths connecting any terminal to any other terminal when the device is tripped or is in a tripped condition. Thus, there is complete electrical isolation between the terminals (face or user accessible, load and line). Bridge 50 electrically connects the phase terminals (line, face and load) terminals to each other and bridge 70 connects the neutral terminals (line, face and load) to each other. Bridge 50 has contacts 52, 62 and 65; bridge 70 has contact 72, 82 and 63. Line terminal 34 extends through the transformers DT and NT to contact 35 and line terminal 38 extends through the transformers DT and NT to contact 39. When the reset button 30 is depressed contact 104 makes contact with contact 106 causing a current imbalance which is detected by the DT transformer causing the IC to energize Q1 which energizes coil 90. The energized coil 90 causes movable floating bridges 50 and 70 to be engaged so that each such floating bridge individually connects a line, load and face terminals to each other. In particular, movable floating bridge 50 connects line terminal 34 to load terminal 36 and face terminal 60. Movable floating bridge 70 connects line terminal 38 to load terminal 40 and face terminal 80. It should be noted that the movable floating bridge can be implemented with contacts located at points occurring prior to the line terminals going through the DT and NT transformers; this is depicted in FIG. 12B. The line terminals, however are to be positioned to that a sensing device (e.g., a differential transformer) can detect a current imbalance between such terminals.

Figure 12C:
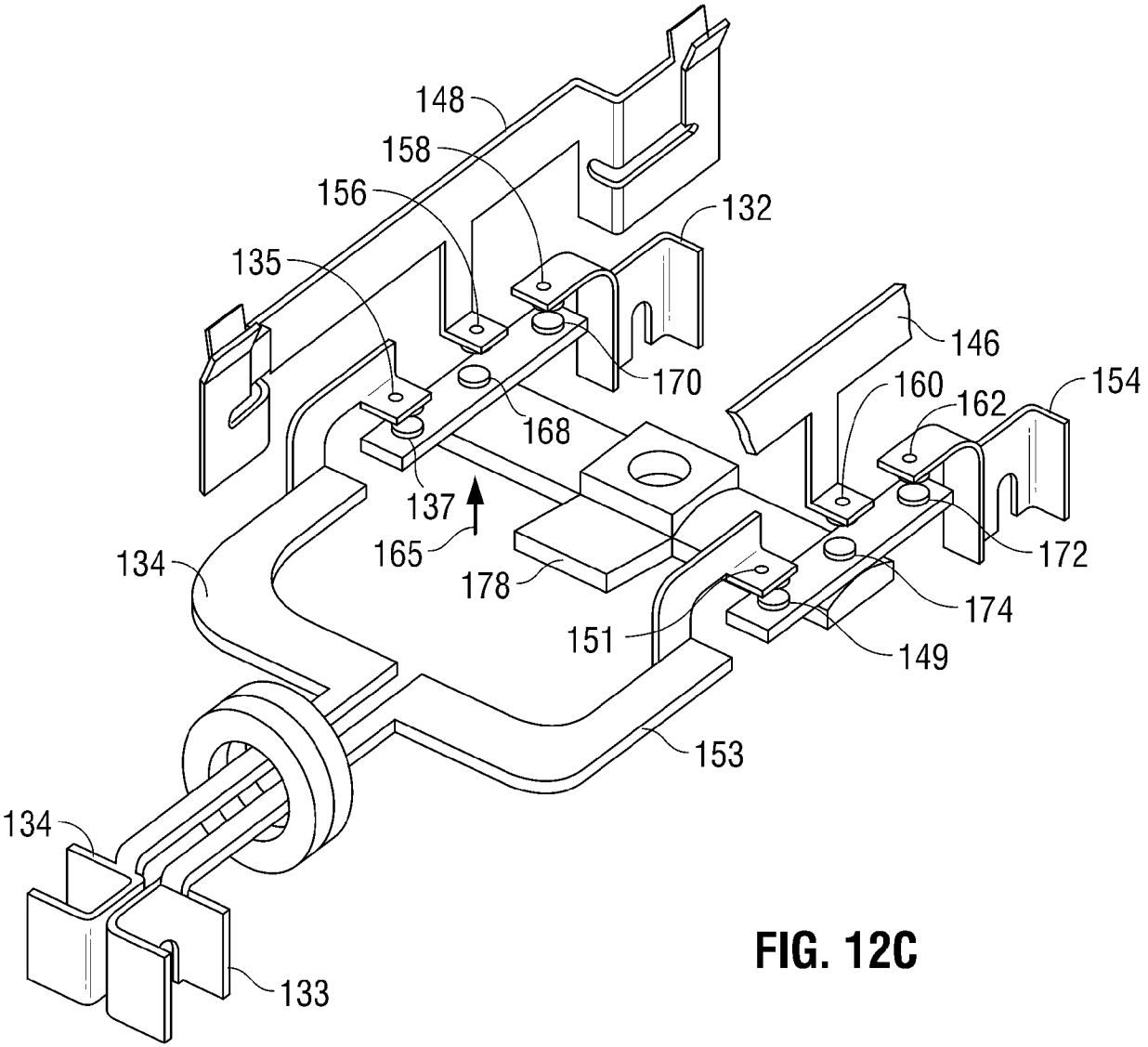
FIG. 12C is a perspective view of an arrangement for a floating movable bridge electrically isolated from the line, load and face terminals.

The floating movable bridge can be implemented using various conductor elements and contacts that interact and/or engage with each other when the GFCI device is tripped or when such a device is being reset. One particular implementation of the movable floating bridge arrangement is shown in FIG. 12C for a GFCI receptacle design disclosed in a patent application having the title "Circuit Interrupting Device And System Utilizing Electromechanical Reset" which was filed on Oct. 22, 2003 and published on Nov. 4, 2004 with Publication No. US 2004/0218316 the entirety of which is incorporated herein by reference. The Publication discloses an electromechanical reset mechanism whereby when the reset button is depressed (while the GFCI is tripped), reset contacts close a circuit that energizes a coil whose movable plunger which engages various mechanical linkages causing an actuator (such a lifter) to engage the movable bridges; see pp. 0049-0053. As discussed in paragraph 0053, the lifter engages the movable bridges causing the device to be reset. In FIG. 12C, the lifter 178 (preferably made from non-conducting material) operates in the same fashion as the one disclosed in the Publication; that is, it moves towards the line, load and face contacts causing the line, load and face terminals to be electrically connected to each other after the reset button has been depressed and is being released by a user. The floating bridges 167A and 167B are fixedly attached to lifter 178 and are made from electrically conducting material. The present invention also contemplates a floating bridge made from non-conducting material but whose contacts are electrically connected to each other. When the device is tripped or is in a tripped condition, the movable floating bridge is electrically isolated from the line, face and load terminals. The electrical isolation means that there are no conductive paths electrically connecting any movable floating bridge to any of the terminals. When the device is tripped the load, face and line terminals are not only electrically isolated from the movable floating bridges, but they are electrically isolated from each other; that is, there are no conductive paths connecting any one terminal to any other terminal when the device is tripped.

As the user releases the depressed reset button, the spring bias of the reset button (not shown in FIG. 12C) causes the lifter 178 (preferably made from electrically non-conducting material) and the attached floating bridges (167A and 167B) to move in the direction shown by arrow 165 allowing the line contacts (137, 149), face contacts (168, 174) and load contacts (170, 172) of the floating bridges to electrically connect to the line (135, 151), load (158, 162) and face contacts (156, 160) respectively thus resetting the device. Face terminal 148 has face contact 156 and face terminal 146 (only a portion of which is shown in FIG. 12C) has face contact 160. The load terminals 132 and 154 have load contacts 158 and 162 respectively. The line terminals 134 and 153 extend through Differential and Ground Neutral transformers and terminate with contacts 135 and 151 respectively. The Differential and Ground Neutral transformers are used to sense any current imbalances between the line terminal conductors 134, 153. Thus, the line terminals are extended as conductors and positioned so as to be monitored by a sensing device (such as transformers) that sense current imbalances between the line terminals 134, 153. In the implementation shown in FIG. 12C, the line terminal conductors are routed through the Differential and Ground Neutral transformers which can then sense a current imbalance between the line terminal conductors. When the device is tripped, the lifter 178 moves in the direction opposite of that shown by arrow 165 disconnecting the terminals from each other and disconnecting the bridge from any of the terminals.

Figure 12D:
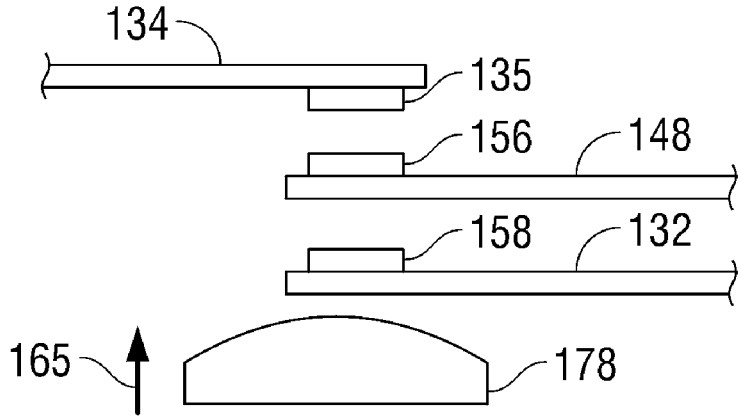
FIG. 12D is a side view of the line, load and face terminal contacts positioned in stacked fashion and can be engaged by the lifter of the GFCI shown in the tripped condition.
Figure 12E:
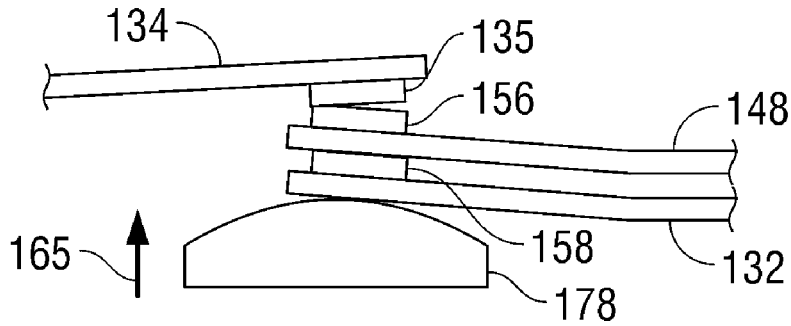
FIG. 12E is FIG. 12D when the GFCI has been reset.

It should be noted that the electrical isolation between the terminals when the device is tripped and the electrical connection of the line load and face terminals when the device is reset can also be implemented without the use of a floating bridge. In particular, the line terminal contact, face terminal contact and load terminal contact can be positioned in stacked fashion with respect to each other. For example, the load terminal contact can be positioned directly above the face terminal contact and the line terminal contact can be positioned directly below the face terminal contact. As the user releases the depressed reset button, the spring bias of the reset button causes an actuator (in the example given—lifter 178) to move to cause the line contact to electrically connect to the face contact and the face contact electrically connect to the load contact thus resetting the device; this is shown in FIGS. 12D and 12E where side views of the contacts electrically isolated with each other and the contacts electrically connected to each other using the lifter 178 are shown. In particular for face terminal 148, load terminal 132 and line terminal 134, the device in the tripped condition is shown in FIG. 12D and the device in the reset position is shown in FIG. 12E. Thus, the actuator (e.g., lifter 178) is positioned so that it can engage at least one of the terminals or terminal contacts to cause said terminals or terminal contact to electrically connect to each other. When the device is tripped lifter 178 moves in a direction opposite that shown by arrow 165 to cause the terminals to be electrically disconnected from each other; that is the terminals have a spring bias so that they return to their particular positions as shown in FIG. 12D.

Referring back to FIG. 12C, the floating bridges 167A and 167B can be permanently attached and be integral with the load terminals or the face terminals or the line terminals. For example, bridge 167A can be permanently connected to and integral with load terminal 132 and positioned to be engaged by lifter 178 (preferably electrically non-conducting) such that when the lifter 178 moves in the direction of arrow 165, the load terminal electrically connects to the face and line terminals. Similarly, bridge 167A can be permanently connected to and integral with face terminal 148 such that when lifter 178 moves in the direction of arrow 165, the face terminal electrically connects to the load and the line terminals; the same arrangement can be done for bridge 167B, load terminal 145 and face terminal 146.

Figure 13:
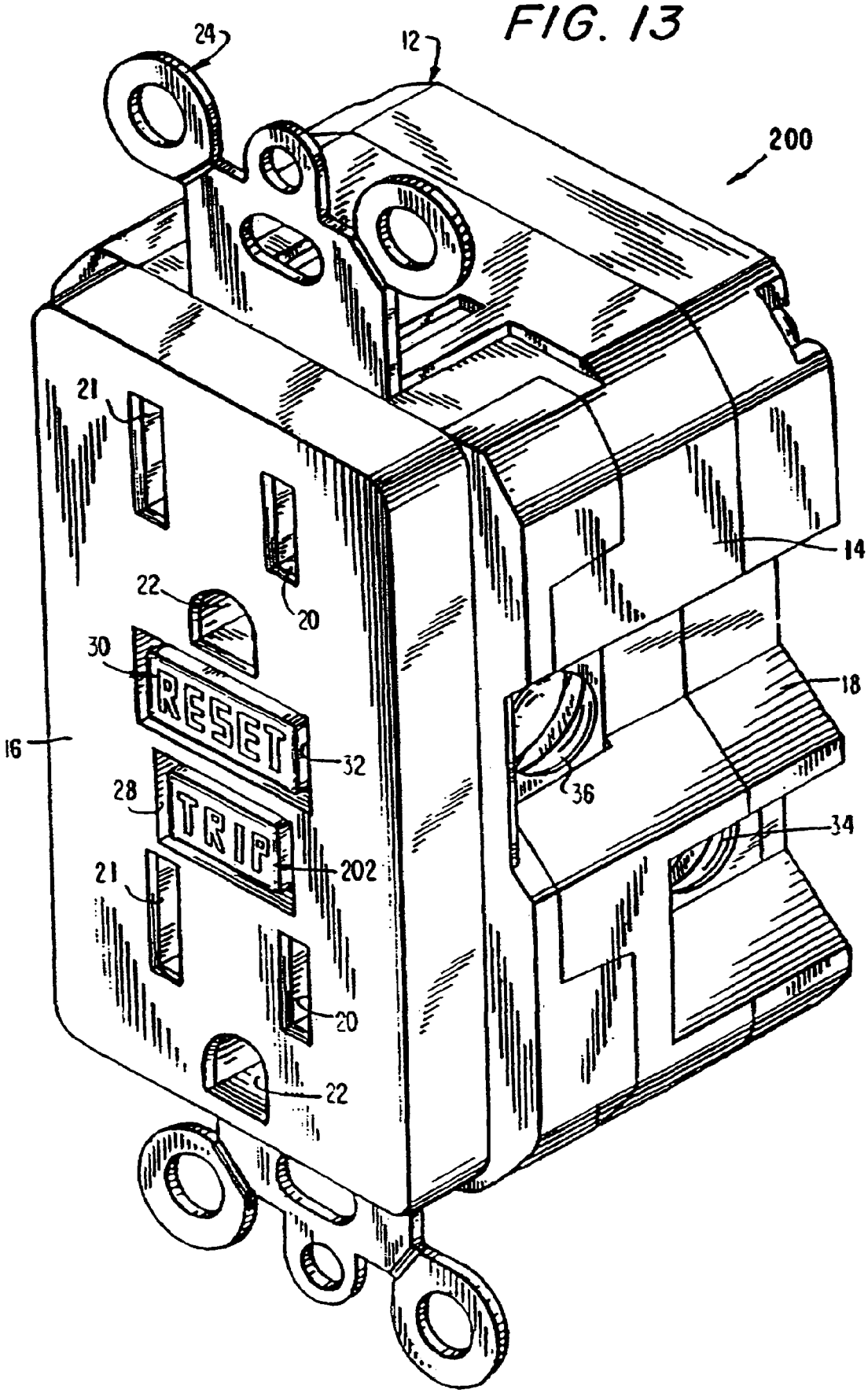
FIG. 13 is a perspective view of an alternative embodiment of a ground fault circuit interrupting device according to the present application.

Turning now to FIG. 13, the GFCI receptacle 200 according to this embodiment is similar to the GFCI receptacle described in FIGS. 1-12. Similar to FIG. 1, the GFCI receptacle 200 has a housing 12 consisting of a relatively central body 14 to which a face or cover portion 16 and a rear portion 18 are, preferably, removably secured.

A trip actuator 202, preferably a button, which is part of the trip portion to be described in more detail below, extends through opening 28 in the face portion 16 of the housing 12. The trip actuator is used, in this exemplary embodiment, to mechanically trip the GFCI receptacle, i.e., break electrical continuity in one or more of the conductive paths, independent of the operation of the circuit interrupting portion.

A reset actuator 30, preferably a button, which is part of the reset portion, extends through opening 32 in the face portion 16 of the housing 12. The reset button is used to activate the reset operation, which re-establishes electrical continuity in the open conductive paths, i.e., resets the device, if the circuit interrupting portion is operational.

As in the above embodiment, electrical connections to existing household electrical wiring are made via binding screws 34 and 36, where screw 34 is an input (or line) phase connection, and screw 36 is an output (or load) phase connection. It should be noted that two additional binding screws 38 and 40 (seen in FIG. 3) are located on the opposite side of the receptacle 200. These additional binding screws provide line and load neutral connections, respectively. A more detailed description of a GFCI receptacle is provided in U.S. Pat. No. 4,595,894, which is incorporated herein in its entirety by reference.

Referring to FIGS. 4-6, 14 and 17, the conductive paths in this embodiment are substantially the same as those described above. The conductive path between the line phase connection 34 and the load phase connection 36 includes, contact arm 50 which is movable between stressed and unstressed positions, movable contact 52 mounted to the contact arm 50, contact arm 54 secured to or monolithically formed into the load phase connection 36 and fixed contact 56 mounted to the contact arm 54 (seen in FIGS. 4, 5 and 17). The user accessible load phase connection for this embodiment includes terminal assembly 58 having two binding terminals 60 which are capable of engaging a prong of a male plug inserted therebetween. The conductive path between the line phase connection 34 and the user accessible load phase connection includes, contact arm 50, movable contact 62 mounted to contact arm 50, contact arm 64 secured to or monolithically formed into terminal assembly 58, and fixed contact 66 mounted to contact arm 64. These conductive paths are collectively called the phase conductive path.

Figure 4:
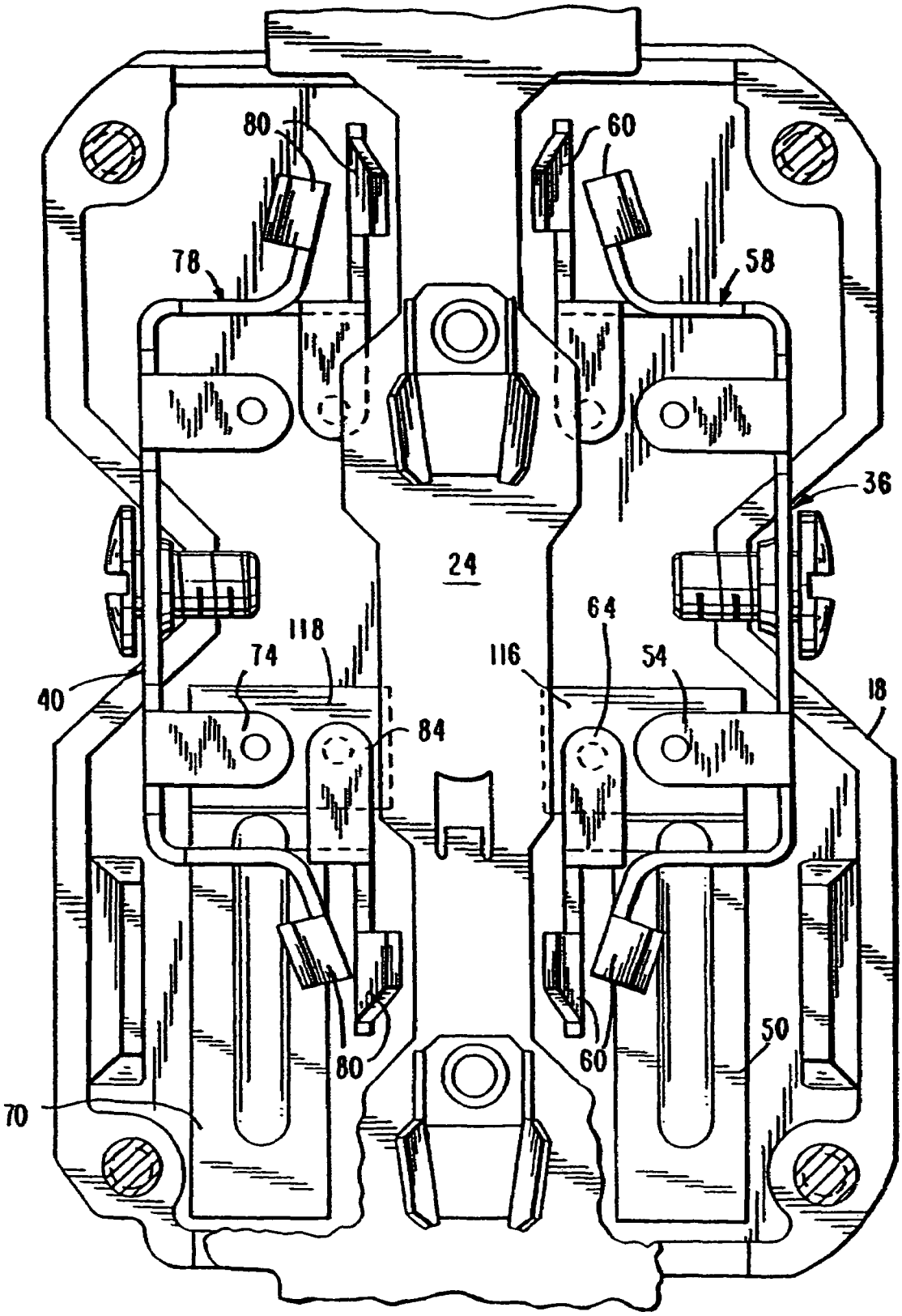
FIG. 4 is a plan view of portions of electrical conductive paths located within the GFCI device of FIG. 1.
Figure 5:
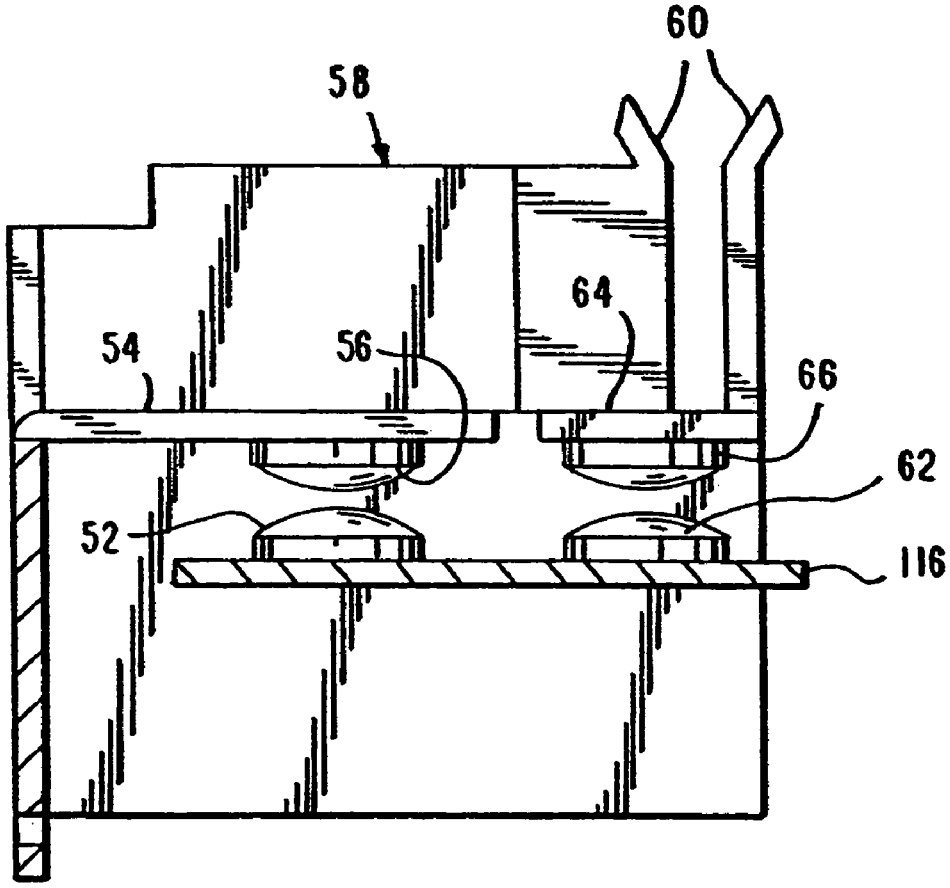
FIG. 5 is a partial sectional view of a portion of a conductive path shown in FIG. 4.
Figure 6:
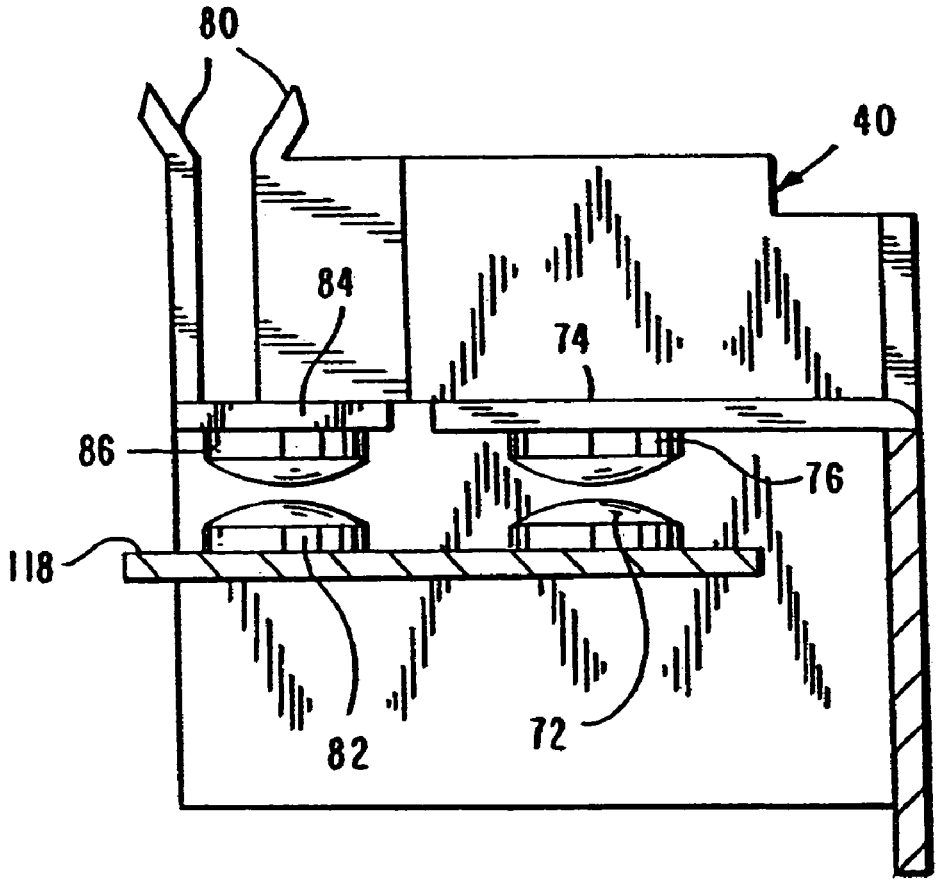
FIG. 6 is a partial sectional view of a portion of a conductive path shown in FIG. 4.
Figure 17:
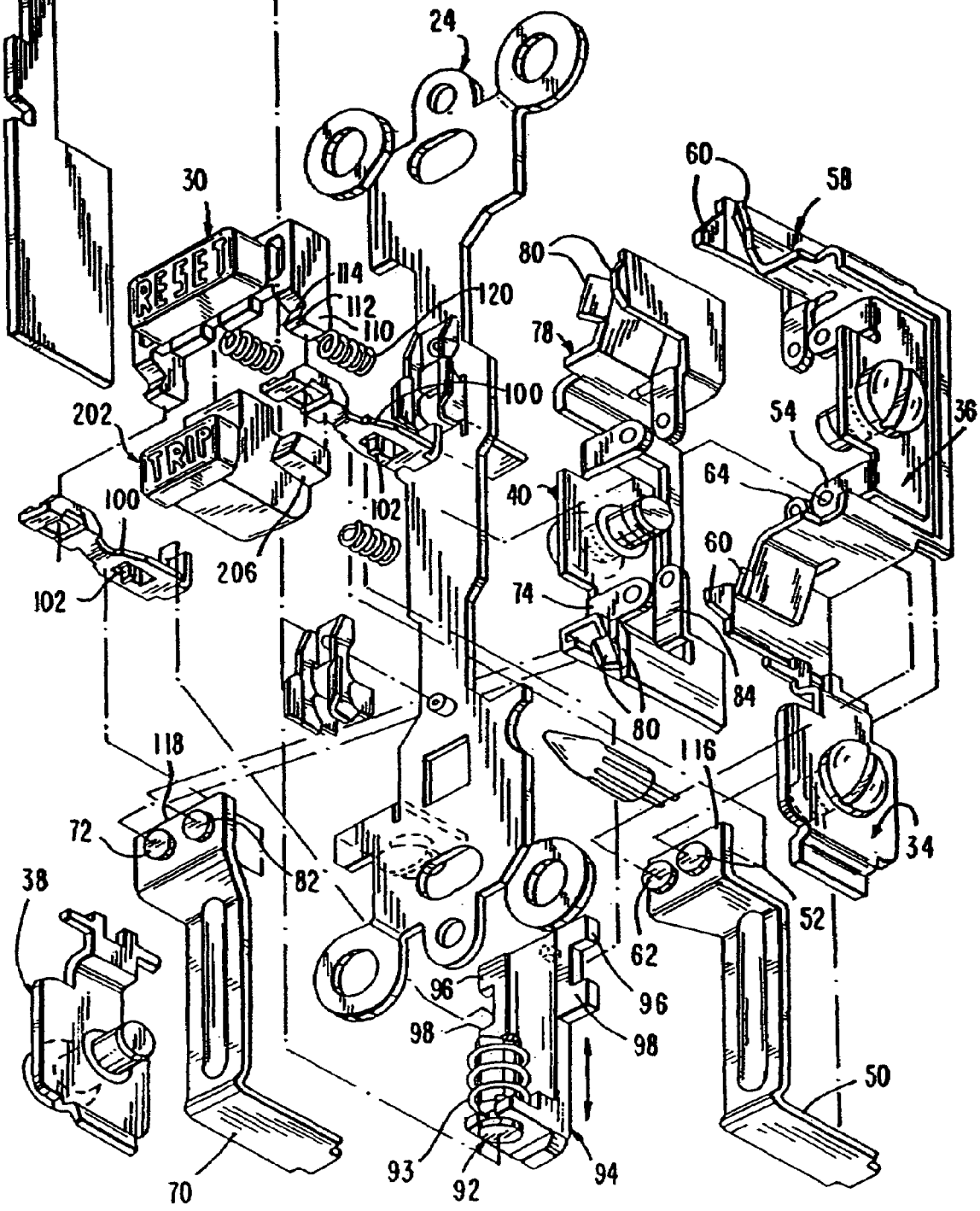
FIG. 17 is an exploded view of internal components of the GFCI device of FIG. 13.

Similarly, the conductive path between the line neutral connection 38 and the load neutral connection 40 includes, contact arm 70 which is movable between stressed and unstressed positions, movable contact 72 mounted to contact arm 70, contact arm 74 secured to or monolithically formed into load neutral connection 40, and fixed contact 76 mounted to the contact arm 74 (seen in FIGS. 4, 6 and 17). The user accessible load neutral connection for this embodiment includes terminal assembly 78 having two binding terminals 80 which are capable of engaging a prong of a male plug inserted therebetween. The conductive path between the line neutral connection 38 and the user accessible load neutral connection includes, contact arm 70, movable contact 82 mounted to the contact arm 70, contact arm 84 secured to or monolithically formed into terminal assembly 78, and fixed contact 86 mounted to contact arm 84. These conductive paths are collectively called the neutral conductive path.

Figure 14:
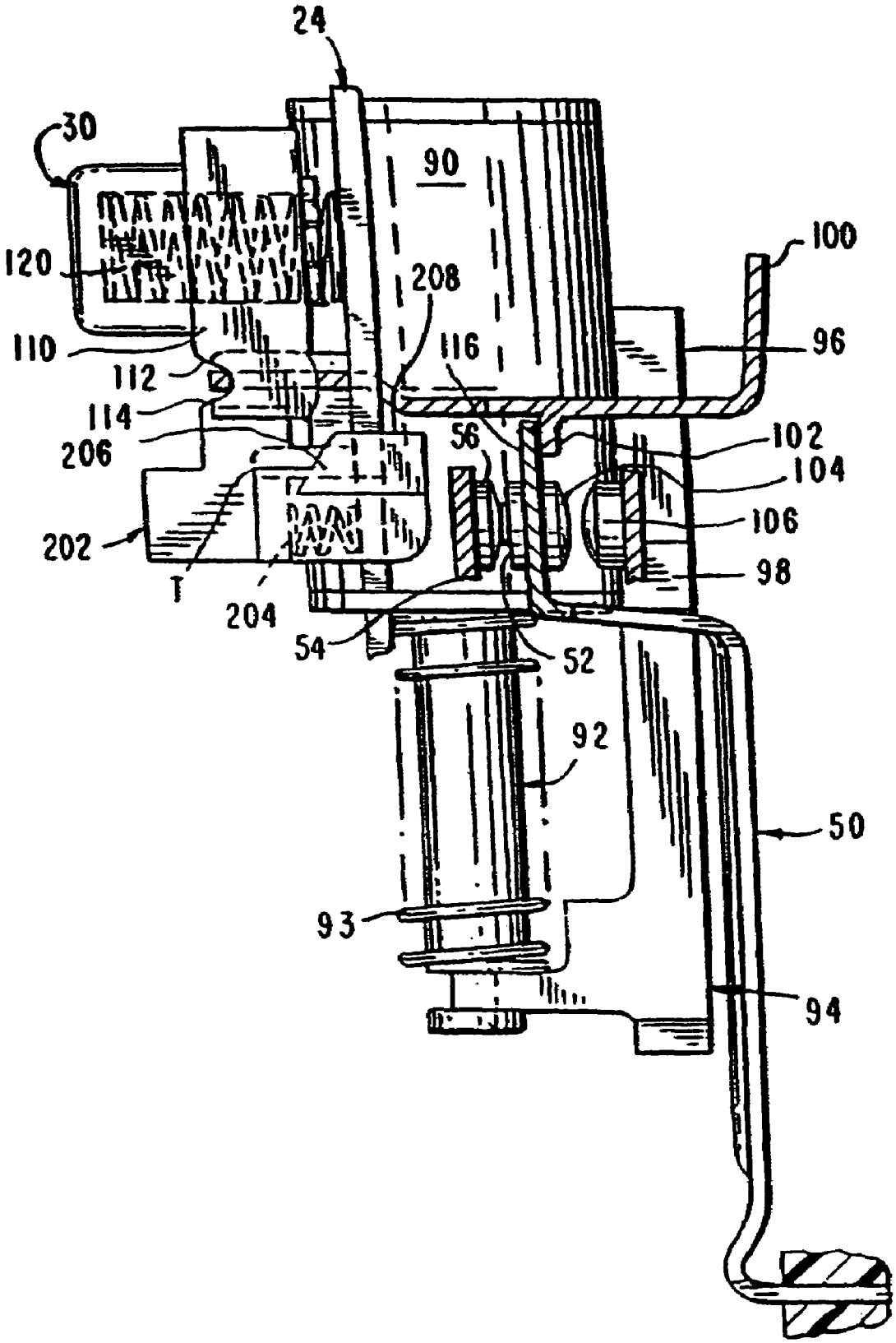
FIG. 14 is side elevational view, partly in section, of a portion of the GFCI device shown in FIG. 13, illustrating the GFCI device in a set or circuit making position.

There is also shown in FIG. 14, mechanical components used during circuit interrupting and reset operations according to this embodiment of the present application. Although these components shown in the drawings are electromechanical in nature, the present application also contemplates using semiconductor type circuit interrupting and reset components, as well as other mechanisms capable of making and breaking electrical continuity.

The circuit interrupting device according to this embodiment incorporates an independent trip portion into the circuit interrupting device of FIGS. 1-12. Therefore, a description of the circuit interrupting, reset and reset lockout portions are omitted.

Figure 15:
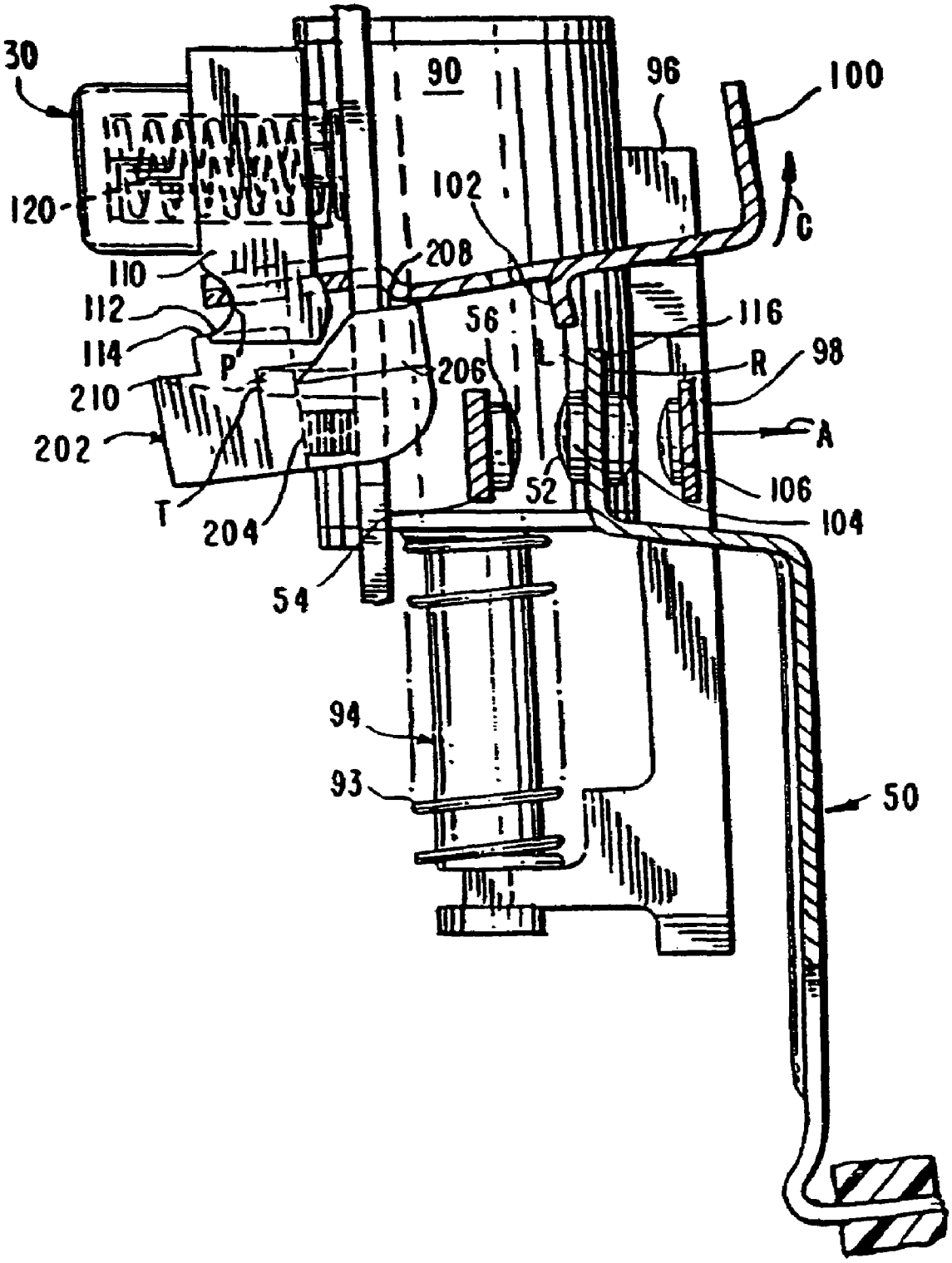
FIG. 15 is a side elevational view similar to FIG. 14, illustrating the GFCI device in a circuit breaking position.
Figure 16:
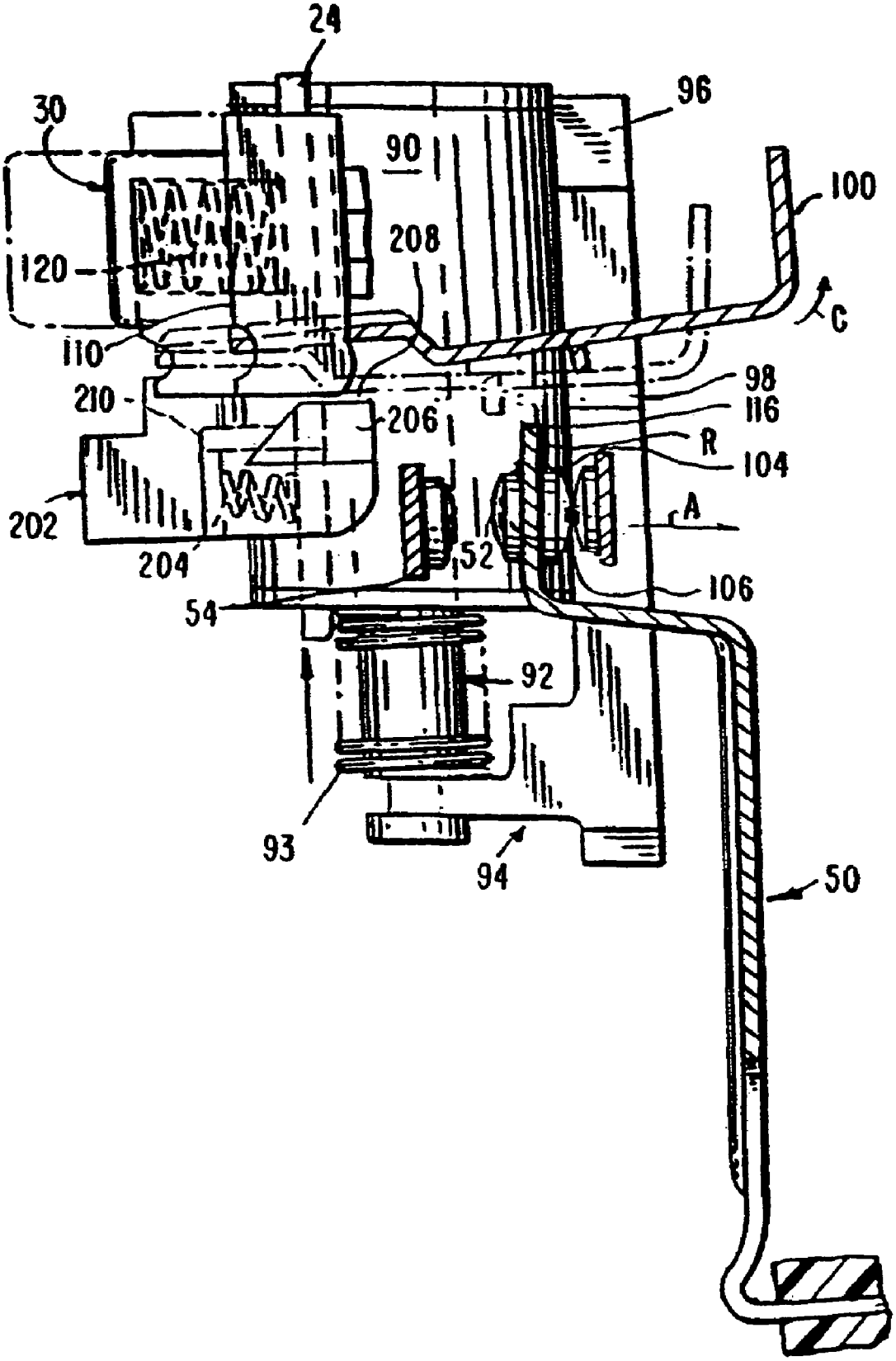
FIG. 16 is a side elevational view similar to FIG. 14, illustrating the components of the GFCI device during a reset operation.

Referring to FIGS. 14-16 an exemplary embodiment of the trip portion according to the present application includes a trip actuator 202, preferably a button, that is movable between a set position, where contacts 52 and 56 are permitted to close or make contact, as seen in FIG. 14, and a trip position where contacts 52 and 56 are caused to open, as seen in FIG. 15. Spring 204 normally biases trip actuator 202 toward the set position. The trip portion also includes a trip arm 206 that extends from the trip actuator 202 so that a surface 208 of the trip arm 206 moves into contact with the movable latching member 100, when the trip button is moved toward the trip position. When the trip actuator 202 is in the set position, surface 208 of trip arm 202 can be in contact with or close proximity to the movable latching member 100, as seen in FIG. 14.

Figure 18:
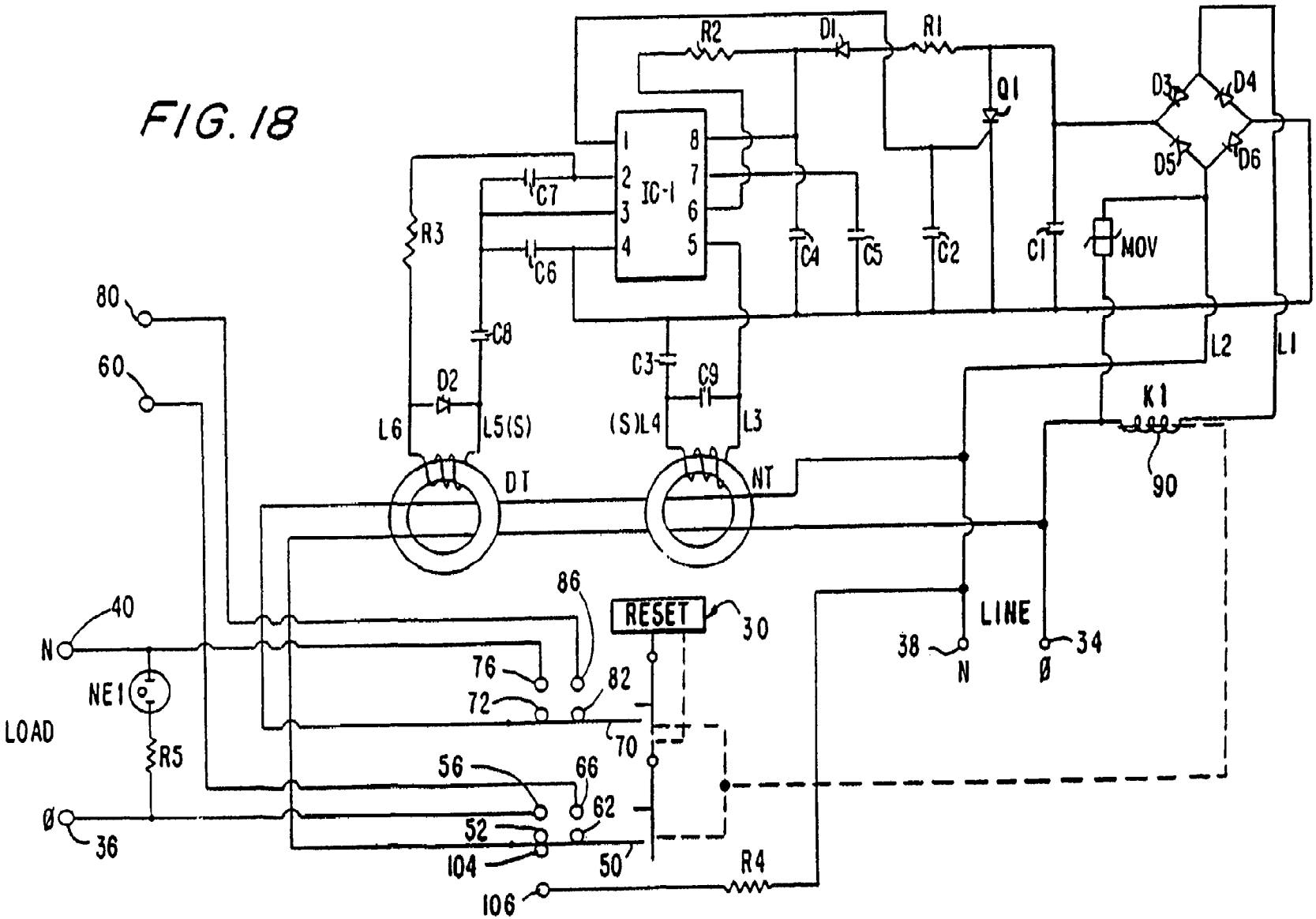
FIG. 18 is a schematic diagram of a circuit for detecting ground faults and resetting the GFCI device of FIG. 13.

In operation, upon depression of the trip actuator 202, the trip actuator pivots about point T of pivot arm 210 (seen in FIG. 15) extending from strap 24 so that the surface 208 of the trip arm 206 can contact the movable latching member 100. As the trip actuator 202 is moved toward the trip position, trip arm 206 also enters the path of movement of the finger 110 associated with reset button 30 thus blocking the finger 102 from further movement in the direction of arrow A (seen in FIG. 15). By blocking the movement of the finger 110, the trip arm 206 inhibits the activation of the reset operation and, thus, inhibits simultaneous activation of the trip and reset operations. Further depression of the trip actuator 202 causes the movable latching member 100 to pivot about point T in the direction of arrow C (seen in FIG. 15). Pivotal movement of the latching member 100 causes latching finger 102 of latching arm 100 to move out of contact with the movable contact arm 50 so that the arm 50 returns to its unstressed condition, and the conductive path is broken. Resetting of the device is achieved as described above. An exemplary embodiment of the circuitry used to sense faults and reset the conductive paths, is shown in FIG. 18.

As noted above, if opening and closing of electrical continuity in the neutral conductive path is desired, the above description for the phase conductive path is also applicable to the neutral conductive path.

Figure 19:
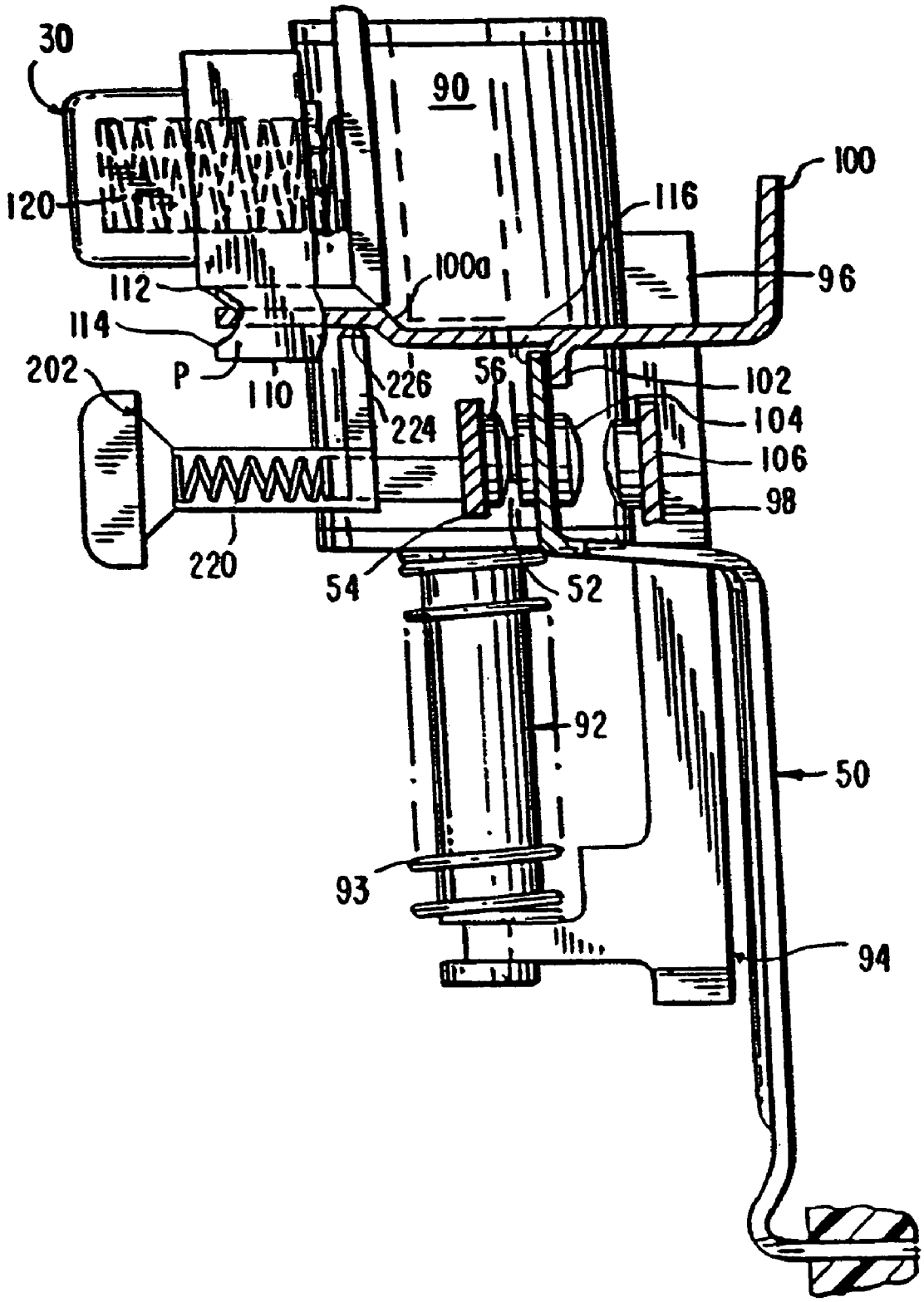
FIG. 19 is side elevational view, partly in section, of components of a portion of the alternative embodiment of the GFCI device shown in FIG. 13, illustrating the device in a set or circuit making position.
Figure 20:
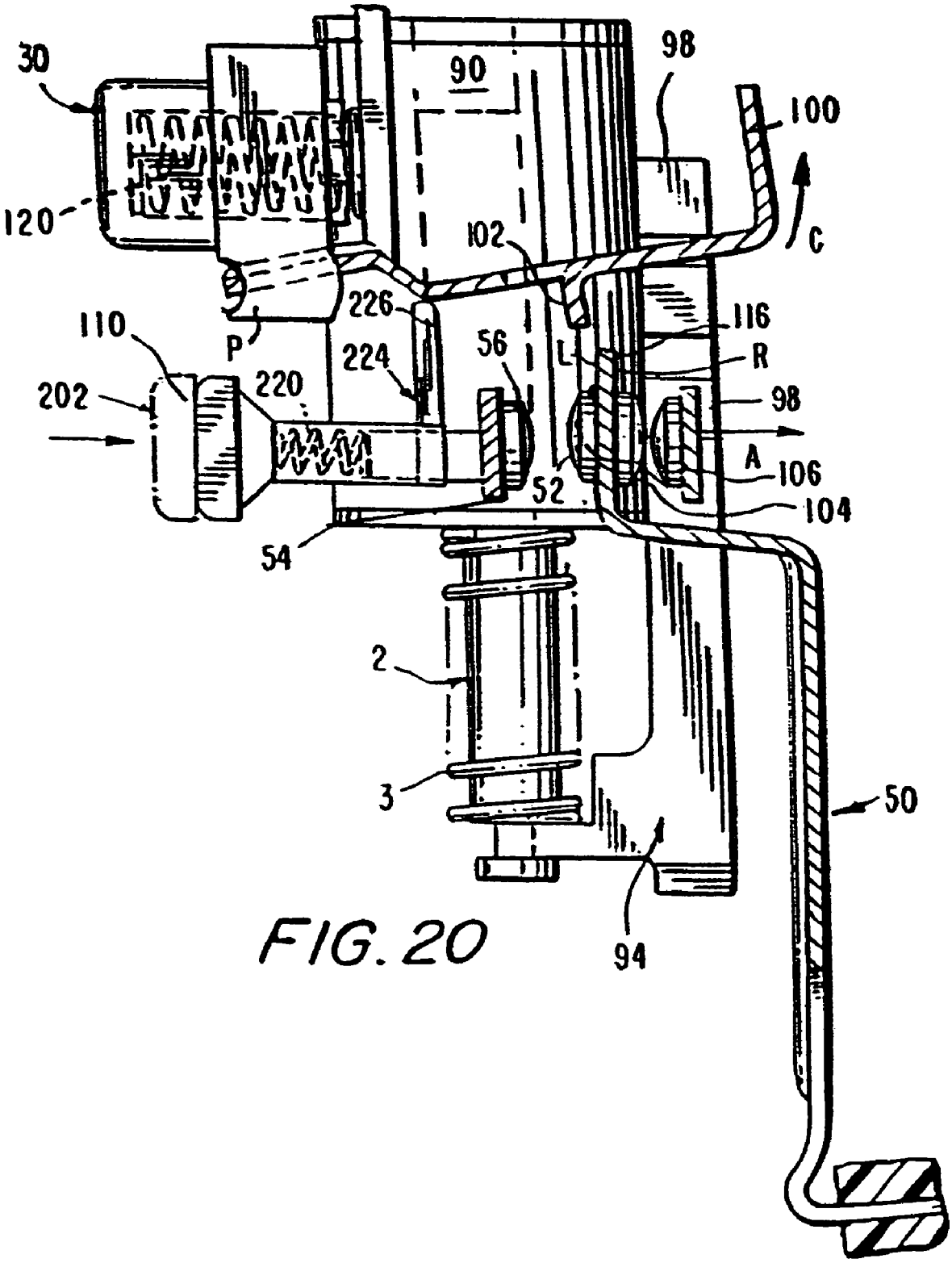
FIG. 20 is a side elevational view similar to FIG. 19, illustrating of the device in a circuit breaking position.

An alternative embodiment of the trip portion will be described with reference to FIGS. 19 and 20. In this embodiment, the trip portion includes a trip actuator 202 that is movable between a set position, where contacts 52 and 56 are permitted to close or make contact, as seen in FIG. 19, and a trip position where contacts 52 and 56 are caused to open, as seen in FIG. 20. Spring 220 normally biases trip actuator 202 toward the set position. The trip portion also includes a trip arm 224 that extends from the trip actuator 202 so that a distal end 226 of the trip arm is in movable contact with the movable latching member 100. As noted above, the movable latching member 100 is, in this embodiment, common to the trip, circuit interrupting, reset and reset lockout portions and is used to make, break or lockout the electrical connections in the phase and/or neutral conductive paths.

In this embodiment, the movable latching member 100 includes a ramped portion 100*a* which facilitates opening and closing of electrical contacts 52 and 56 when the trip actuator 202 is moved between the set and trip positions, respectively. To illustrate, when the trip actuator 202 is in the set position, distal end 226 of trip arm 224 contacts the upper side of the ramped portion 100*a*, seen in FIG. 19. When the trip actuator 202 is depressed, the distal end 226 of the trip arm 224 moves along the ramp and pivots the latching member 60 about point P in the direction of arrow C causing latching finger 102 of the latching member 100 to move out of contact with the movable contact arm 50 so that the arm 50 returns to its unstressed condition, and the conductive path is broken. Resetting of the device is achieved as described above.

Figure 21:
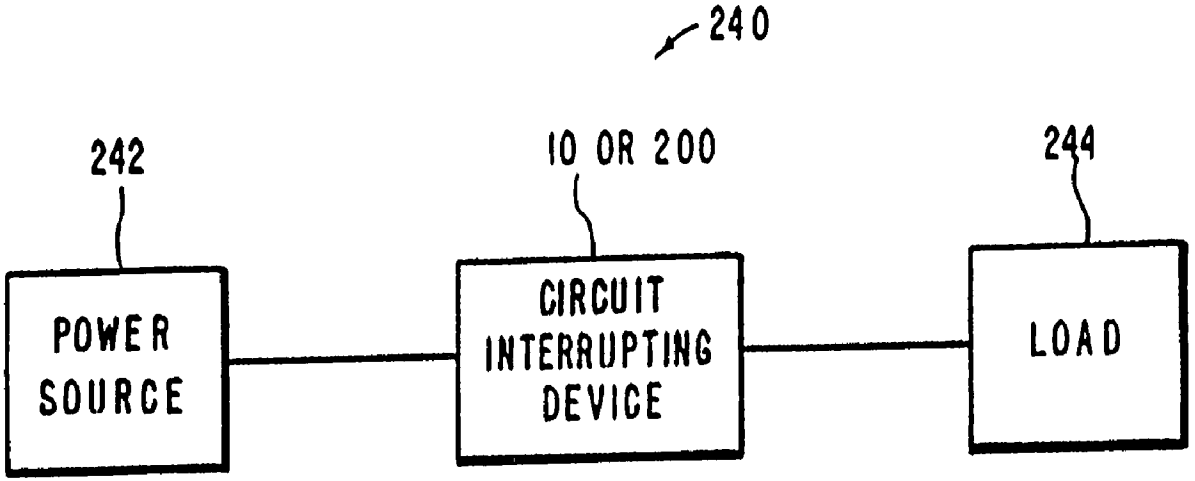
FIG. 21 is a block diagram of a circuit interrupting system according to the present application.

The circuit interrupting device according to the present application can be used in electrical systems, shown in the exemplary block diagram of FIG. 21. The system 240 includes a source of power 242, such as ac power in a home, at least one circuit interrupting device, e.g., circuit interrupting device 10 or 200, electrically connected to the power source, and one or more loads 244 connected to the circuit interrupting device. As an example of one such system, ac power supplied to single gang junction box in a home may be connected to a GFCI receptacle having one of the above described reverse wiring fault protection, independent trip or reset lockout features, or any combination of these features may be combined into the circuit interrupting device. Household appliances that are then plugged into the receptacle become the load or loads of the system.

As noted, although the components used during circuit interrupting and device reset operations are electromechanical in nature, the present application also contemplates using electrical components, such as solid state switches and supporting circuitry, as well as other types of components capable or making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed:

1. A circuit interrupting device comprising:

at least one first electrical conductor;

at least one second electrical conductor;

at least one third electrical conductor where at least one of the first, second, and third conductors are disposed to be connected to a source of electricity, at least one of the first, second, and third conductors are disposed to be connected to a load, and the at least one first, second, and third conductors are electrically connected to each other when positioned in a first relative spatial arrangement and are electrically isolated from each other when positioned in a second relative spatial arrangement; and at least one movable and substantially rectangular floating bridge for establishing the electrical connection when the disposed conductors are positioned in the first relative spatial arrangement.

2. The circuit interrupting device of claim 1 where the at least one movable floating bridge is positioned in a first position so as to electrically connect the first electrical conductor to the second and third electrical conductors when the device is reset and the at least one movable floating bridge is positioned in a second position so as to disconnect electrically the first, second, and third electrical conductors such that the first, second and third electrical conductors are all electrically isolated when the device is in a trip condition.

3. The circuit interrupting device of claim 2 where the at least one movable floating bridge has:

three contacts attached thereto where such contacts are positioned so as to be electrically connected to corresponding three contacts one of which is electrically connected to the first electrical conductor, the second of which is electrically connected to the second electrical conductor and the third of which is connected to the third electrical conductor when the movable floating bridge is in the first position.

4. The circuit interrupting device of claim 3, wherein each of the three contacts are disposed on a common side of the movable floating bridge.

5. The circuit interrupting device of claim 1 further comprising a trip portion that is configured to cause electrical discontinuity between the first, second and third electrical conductors.

6. The circuit interrupting device of claim 5 where the trip portion comprises an actuator positioned in a first position so as to interact with the movable floating bridge for positioning the movable floating bridge in the first position.

7. The circuit interrupting device of claim 6 where the actuator is positioned in a second position so as to interact with the movable floating bridge for positioning the movable floating bridge in the second position.

8. The circuit interrupting device of claim 1 further comprising a sensing circuit for detecting an occurrence of a predetermined condition.

9. The circuit interrupting device of claim 1 where the third electrical conductor comprises a contact connected to an electrically conducting frame forming a receptacle that is accessible to a user of the device.

10. The circuit interrupting device of claim 1 where at least one of the first and second electrical conductors is positioned so that it can be monitored by a sensing device.

11. The circuit interrupting device of claim 1 where the at least one first electrical conductor includes a first conductor disposed to connect to the source of electricity, the at least one second electrical conductor includes a second conductor disposed to connect to the load and, and the at least one third electrical conductor is disposed to be connected to at least one of a user accessible plug and receptacle.

12. The circuit interrupting device of claim 11 where at least two of the at least one first, second, and the third conductors are movable for moving from the second spatial arrangement to the first spatial arrangement in which at least one of the movable conductors is moved into contact with the other movable conductor which in turn causes each of the movable conductors to contact at least one other conductor of the at least one first, second, and the third conductors.

13. The circuit interrupting device of claim 1 further comprising a circuit interrupter configured to cause electrical discontinuity between said first, second and third conductors upon the occurrence of a predetermined condition.

14. The circuit interrupting device of claim 13 where the condition comprises a ground fault, an arc fault, an appliance leakage fault, an equipment leakage fault or an immersion detection fault.

15. The circuit interrupting device of claim 13 where the circuit interrupter comprises a coil and plunger assembly at least one actuator and a sensing circuit used to detect the predetermined condition.

16. A circuit interrupting device comprising:

a first pair of terminals capable of being electrically connected to a source of electricity;

a second pair of terminals capable of conducting electrical current to a load when electrically connected to said first pair or terminals;

a third pair of terminals capable of being electrically connected to user accessible plugs and/or receptacles where the first, second and third pair of terminals are electrically isolated from each other;

at least one movable and substantially rectangular bridge electrically isolated from said first, second and third pair of terminals and capable of electrically connecting the first, second and third pairs of terminals to each other; and a circuit interrupting portion configured to cause electrical discontinuity between said first, second and third pairs of terminals upon the occurrence of a predetermined condition.

17. The circuit interrupting device of claim 16 where the at least one movable bridge is positioned in a first position so as to electrically connect the first pair of terminals to the second and third pairs of terminals when the device is reset and the movable bridge is positioned in a second position so as to disconnect electrically the first, second, and third pairs of terminals from each other when the device is in a trip condition.

18. The circuit interrupting device of claim 17 further comprising a trip portion that is configured to cause electrical discontinuity between the first, second and third pairs of terminals.

19. The circuit interrupting device of claim 18 where the trip portion includes an actuator positioned in a first position so as to interact with the at least one movable bridge for positioning the at least one movable bridge in the first position.

20. The circuit interrupting device of claim 19 where the actuator is positioned in a second position so as to interact with the at least one movable bridge for positioning the at least one movable bridge in the second position.

21. The circuit interrupting device of claim 16 where the condition comprises a ground fault, an arc fault, an appliance leakage fault, equipment leakage fault or an immersion detection fault.

22. The circuit interrupting device of claim 16 further comprising a sensing circuit for detecting an occurrence of a predetermined condition.

23. The circuit interrupting device of claim 16 where the circuit interrupting device portion comprises a coil and plunger assembly, the at least one movable bridge and a sensing circuit used to detect a predetermined condition.

24. The circuit interrupting device of claim 16 where the at least one movable bridge has:

three pairs of contacts attached thereto and where such first pair is positioned so as to make electrical contact with a corresponding pair of line terminal contacts when the movable bridge is positioned in the first position;

a second pair of contacts positioned so as to make electrical contact with a corresponding pair of load terminal contacts when the movable bridge is positioned in the first position; and a third pair of contacts positioned so as to make electrical contact with a corresponding pair of user accessible terminal contacts when the movable bridge is positioned in the first position.

25. The circuit interrupting device of claim 24 wherein each of the three pairs of contacts are disposed on a common side of the movable bridge.

26. The circuit interrupting device of claim 16 where the third pair of terminals comprises a pair of contacts connected to a pair of electrically conducting frames forming a pair of receptacles that is accessible to a user of the device.

27. The circuit interrupting device of claim 16 where at least one of the first and second pairs of terminals is positioned so that it can be monitored by a sensing device.

28. The circuit interrupting device of claim 16 where at least two of the at least one first, second, and the third pairs of terminals are movable for moving from the second spatial arrangement to the first spatial arrangement in which at least one of the movable pairs of terminals is moved into contact with the other movable pair of terminals which in turn causes each of the movable pairs of terminals to contact at least one other pair of terminals of the at least one first, second, and the third pairs of terminals.

29. A method for providing circuit interruption using a circuit interruption device, the device comprising at least one first electrical conductor, at least one second electrical conductor, and at least one third electrical conductor, the method comprising:

disposing at least one of the at least one first, second, and third electrical conductors for connection to a source of electricity;

disposing at least one of the at least one first, second, and third electrical conductors for connection to a load;

positioning the at least one first, second, and third electrical conductors in a first relative spatial arrangement in which the at least one first, second, and third electrical conductors are electrically connected with one another;

positioning the at least one first, second, and third electrical conductors in a second relative spatial arrangement in which the at least one first, second, and third electrical conductors are electrically isolated from each other; and moving a substantially rectangular floating bridge for establishing the electrical connection when the disposed conductors are positioned in the first relative spatial arrangement.

30. The method of claim 29 further comprising:

positioning the movable floating bridge in a first position to electrically connect the at least one first, second, and third electrical conductors to each other when in a reset condition; and positioning the movable floating bridge in a second position to electrically disconnect electrically the at least one first, second, and third electrical conductors from each other and be electrically isolated from the at least one first, at least one second and third electrical conductors when in a trip condition.

31. The method of claim 29 further comprising positioning at least one first, at least one second and a third contact on the movable floating bridge for electrically connecting to the at least one first, the at least one second and the third electrical conductors, respectively.

32. The circuit interrupting device of claim 31 wherein the at least one first contact and the at least one second and third contact are disposed on a common side of the movable bridge.

33. The method of claim 30 further comprising acting upon the movable floating bridge in response to a first user actuation of a trip actuator for positioning the movable bridge in the first position.

34. The method of claim 33 further comprising acting upon the movable floating bridge in response to a second user actuation of the trip actuator for positioning the movable bridge in the second position.

35. The method of claim 29 further comprising causing electrical discontinuity between said at least one first and second and said third conductors upon the occurrence of a predetermined condition.

36. The method of claim 35 where the condition comprises a ground fault, an arc fault, an appliance leakage fault, an equipment leakage fault or an immersion detection fault.

37. The method of claim 35 further comprising detecting an occurrence of the predetermined condition.

* * * * *

UNITED STATES PATENT AND TRADEMARK OFFICE

CERTIFICATE OF CORRECTION

PATENT NO. : 7,944,331 B2
APPLICATION NO. : 11/265803
DATED : May 17, 2011
INVENTOR(S) : James A. Porter et al.

It is certified that error appears in the above-identified patent and that said Letters Patent is hereby corrected as shown below:

Page 1, Cover Sheet:

Related U.S. Application Data, (63), "Continuation-in-part of application No. 10/692,056, filed on Oct. 22, 2003, now Pat. No. 7,049,911, which is a continuation of application No. 10/690,776, filed on Oct. 22, 2003, now Pat. No. 7, 737,809." and (60) "Provisional application No. 60/444,469, filed on Feb. 3, 2003." should read as follows:

-- This application is a continuation-in-part of an application having Application Ser. No. 10/692,056 filed on Oct. 22, 2003, now U.S. Pat. No. 7,049,911 which issued on May 23, 2006, which claims priority to a provisional application having Provisional Application No. 60/444,469 filed on Feb. 3, 2003. This application is also a continuation-in-part application of an application having Application Ser. No. 10/690,776 filed on Oct. 22, 2003, now U.S. Pat. No. 7,737,809 which issued on June 15, 2010, which claims priority to a provisional application having Provisional Application No. 60/444,469 filed on Feb. 3, 2003. --

Signed and Sealed this
Twenty-second Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,944,331 B2
APPLICATION NO. : 11/265803
DATED : May 17, 2011
INVENTOR(S) : James A. Porter et al.

It is certified that error appears in the above-identified patent and that said Letters Patent is hereby corrected as shown below:

Column 15, in Claim 16, line 45, please delete "pair or terminals" and replace with --pair of terminals, respectively;-- and in line 53, please delete "other;" and replace with --other, respectively;--.

Column 15, in Claim 17, line 63, please add --, respectively,-- between the words "terminals" and "when".

Signed and Sealed this
Third Day of April, 2012

David J. Kappos

David J. Kappos
*Director of the United States Patent and Trademark Office*